US011402780B2

(12) United States Patent
Otsuka et al.

(10) Patent No.: US 11,402,780 B2
(45) Date of Patent: Aug. 2, 2022

(54) FIXING DEVICE AND IMAGE FORMING DEVICE

(71) Applicant: Konica Minolta, Inc., Tokyo (JP)

(72) Inventors: Yutaka Otsuka, Aichi (JP); Tomoya Sato, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/388,498

(22) Filed: Jul. 29, 2021

(65) Prior Publication Data

US 2022/0043374 A1 Feb. 10, 2022

(30) Foreign Application Priority Data

Aug. 7, 2020 (JP) ..... JP2020-135201
Aug. 7, 2020 (JP) ..... JP2020-135202

(51) Int. Cl.
*G03G 15/20* (2006.01)

(52) U.S. Cl.
CPC ..... *G03G 15/205* (2013.01); *G03G 15/2039* (2013.01)

(58) Field of Classification Search
CPC ..... G03G 15/205; G03G 15/2039
USPC ..... 399/33, 67, 69, 70
See application file for complete search history.

(56) References Cited

U.S. PATENT DOCUMENTS

2015/0055969 A1* 2/2015 Tanaka ..... G03G 15/6529 399/69
2015/0093136 A1* 4/2015 Koda ..... G03G 15/2039 399/68
2021/0302879 A1* 9/2021 Hasegawa ..... G03G 15/2064

FOREIGN PATENT DOCUMENTS

JP 2008-020533 A 1/2008
JP 2015-096889 A 5/2015
JP 2017-009746 A 1/2017
JP 2017-026739 A 2/2017
JP 2017-107086 A 6/2017

* cited by examiner

*Primary Examiner* — Robert B Beatty
(74) *Attorney, Agent, or Firm* — Lucas & Mercanti, LLP

(57) ABSTRACT

A fixing device including: a heating rotating body; a pressure member pressed against the heating rotating body to form a nip; a first acquisition unit that acquires a first index value indicating a change in coefficient of friction between the heating rotating body and the pressure member; a second acquisition unit that acquires a second index value indicating a change in rigidity of an elastic layer in the heating rotating body and/or the pressure member; and a controller that executes at least one of two controls according to the index values: a first control during idling rotation after fixing job execution, for controlling temperature of the heating rotating body and time from a start of the idling rotation to an end of the idling rotation and a second control during idling rotation before and/or after fixing job execution, for controlling rotation speed of the heating rotating body.

22 Claims, 16 Drawing Sheets

Model illustrating a mechanism of stick-slip occurrence

FIG. 16

| Temperature of heating roller at start of WU (°C) | Previously backed up total control time S(n-1) | | | | | | |
|---|---|---|---|---|---|---|---|
| | 1000 | 800 | 600 | ··· | 90 | 30 | 0 |
| · | · | · | · | ··· | · | · | · |
| · | · | · | · | ··· | · | · | · |
| · | · | · | · | ··· | · | · | · |
| 10 | 0 | 0 | 0 | ··· | 0 | 0 | 0 |
| 15 | 0 | 0 | 0 | ··· | 0 | 0 | 0 |
| 20 | 0 | 0 | 0 | ··· | 0 | 0 | 0 |
| 25 | 0 | 0 | 0 | ··· | 0 | 0 | 0 |
| 30 | 0 | 0 | 0 | ··· | 0 | 0 | 0 |
| 35 | 5 | 5 | 5 | ··· | 5 | 5 | 5 |
| 40 | 10 | 10 | 10 | ··· | 10 | 10 | 10 |
| 45 | 33 | 30 | 20 | ··· | 14 | 11 | 11 |
| 50 | 55 | 50 | 30 | ··· | 18 | 13 | 13 |
| 55 | 78 | 70 | 40 | ··· | 21 | 14 | 14 |
| 60 | 100 | 90 | 50 | ··· | 25 | 15 | 15 |
| 65 | 125 | 115 | 80 | ··· | 35 | 24 | 16 |
| 70 | 150 | 140 | 110 | ··· | 45 | 33 | 18 |
| 75 | 175 | 165 | 140 | ··· | 55 | 41 | 19 |
| 80 | 200 | 190 | 170 | ··· | 65 | 50 | 20 |
| 85 | 238 | 223 | 198 | ··· | 74 | 55 | 23 |
| 90 | 275 | 255 | 225 | ··· | 83 | 60 | 25 |
| 95 | 313 | 288 | 253 | ··· | 91 | 65 | 28 |
| 100 | 350 | 320 | 280 | ··· | 100 | 70 | 30 |
| · | · | · | · | ··· | · | · | · |
| · | · | · | · | ··· | · | · | · |
| · | · | · | · | ··· | · | · | · |

FIXING DEVICE AND IMAGE FORMING DEVICE

This application claims priority to Japanese Patent Applications No. 2020-135201, filed on Aug. 7, 2020, and No. 2020-135202, filed on Aug. 7, 2020 the contents of which are hereby incorporated herein by reference in their entirety.

BACKGROUND

(1) Technical Field

The present disclosure relates to fixing devices that thermally fix unfixed images on sheets, and image forming devices including such fixing devices.

(2) Description of the Related Art

An electrophotographic image forming device includes a fixing device for thermally fixing an unfixed toner image formed on a sheet. The fixing device has a structure in which a pressure rotating body is pressed against the circumferential surface of a heated rotating body heated by a heat source to form a nip, and a sheet carrying an unfixed toner image is passed through the nip.

A width of the nip in the sheet passing direction (hereinafter also referred to as "nip width") is required to have a defined size so as not to cause uneven fixing when thermally fixing, and therefore an elastic layer is formed on one or both of the pressure rotating body and the heated rotating body.

After fixing a sheet, when rotation of the heated rotating body and the pressure rotating body (hereinafter also collectively referred to as "nip forming rotating bodies") is stopped, the nip becomes hot, causing the nip forming rotating bodies to deteriorate, and therefore normally idling rotation (rotation without a sheet passing through) is continued for a defined time to allow heat dissipation, warming the entire fixing device.

The nip forming rotating bodies are structured so that only one rotating body (typically the pressure rotating body) has a rotational drive and the other rotating body is driven, and therefore during idling rotation when a sheet is not passing through, minute slips occur intermittently in the elastic layers of the nip between the rotating bodies, a phenomenon known as "stick-slip", and this may generate unusual noise.

When unusual noise is generated it can be very jarring, especially in a quiet office, and may lead to a misunderstanding that the image forming device is malfunctioning, and therefore generation of such unusual noise is preferably suppressed as much as possible.

Empirically, the higher the traveling speed (feeding speed in the sheet passing direction) of the nip forming rotating bodies, the less likely it is that unusual noise due to the stick-slip phenomenon (hereinafter also referred to as "stick-slip noise") is generated. For example, according to Japanese Patent Application Publication No. 2008-20533, traveling speed during idling rotation is set to a relatively high speed.

However, idling rotation is stopped after a defined time elapses, for example 15 seconds, but when rotation is suddenly stopped from a relatively high speed, for example 100 mm/s, damage to material of the nip forming rotating bodies is large and this leads to a shortening of the life of the fixing device, and therefore rotation speed is usually reduced gradually.

In this case, even if stick-slip noise can be avoided by high speed rotation at the start of idling rotation, stick-slip noise may be generated in a certain low speed range when rotation speed is gradually reduced to stop the idling rotation.

Further, according to the structure disclosed in Japanese Patent Application Publication No. 2008-20533, rotation speed of the nip forming rotating bodies is mechanically increased during idling without specific consideration of stick-slip occurrence, and therefore unnecessary increase in travel distance of the nip forming rotating bodies, increased wear and deterioration of elastic properties of the material, and shortened life of the fixing device are unavoidable.

According to Japanese Patent Application Publication No. 2017-107086, a total number of past jobs and a number of sheets passing through are stored, and a value of total jobs divided by number of sheets (average number of jobs per sheet) is stored, and idling rotation speed is changed based on these values, but even in this case, stick-slip generation conditions are not sufficiently evaluated, and unnecessary high speed rotation leads to a shortened lifespan.

SUMMARY

The present disclosure is made in view of the above technical problems, and an object of the present disclosure is to provide a fixing device capable of suppressing stick-slip noise as much as possible without causing life-shortening during stopping of idling rotation, and to provide an image forming device including the fixing device.

Further, an object of the present disclosure is to provide the fixing device capable of accurately controlling rotation speed during idling to prevent generation of stick-slip noise, while suppressing shortening of life of the fixing device as much as possible, and to provide the image forming device including the fixing device.

In order to achieve at least the above object, a fixing device that reflects one aspect of the present disclosure is a fixing device that executes a fixing job by passing a sheet on which an unfixed toner image is formed through a nip, the fixing device comprising: a heating rotating body heated by a heater; a pressure member pressed against the heating rotating body to form the nip; a first acquisition unit that acquires a first index value indicating a change in coefficient of friction between the heating rotating body and the pressure member; a second acquisition unit that acquires a second index value indicating a change in rigidity of an elastic layer in the heating rotating body and/or the pressure member; and a controller that executes at least one of two controls according to the first index value and the second index value: a first control during idling rotation after fixing job execution, for controlling temperature of the heating rotating body and time from a start of the idling rotation to an end of the idling rotation and a second control during idling rotation before and/or after fixing job execution, for controlling rotation speed of the heating rotating body.

Another aspect of the present disclosure is an image forming device comprising: an imaging section that forms an unfixed toner image on a sheet; and a fixing section that fixes the unfixed toner image on the sheet, wherein the fixing section includes the fixing device that fixes the unfixed toner image on the sheet by passing the sheet through a nip

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present invention.

FIG. 16 is a table showing results of a simulation when a degree of warming of a fixing section according to a modification is corrected by temperature of a heating roller at the start of warm-up.

DETAILED DESCRIPTION

Hereinafter, one or more embodiments of the present disclosure will be described with reference to the drawings. However, the scope of the invention is not limited to the disclosed embodiments.

Embodiment 1

The following is a description of a tandem type color printer (hereinafter simply referred to as "printer"), described with reference to the drawings as an example of an image forming device pertaining to Embodiment 1 of the present disclosure.

1. Overall Structure of Printer

Figure 1:
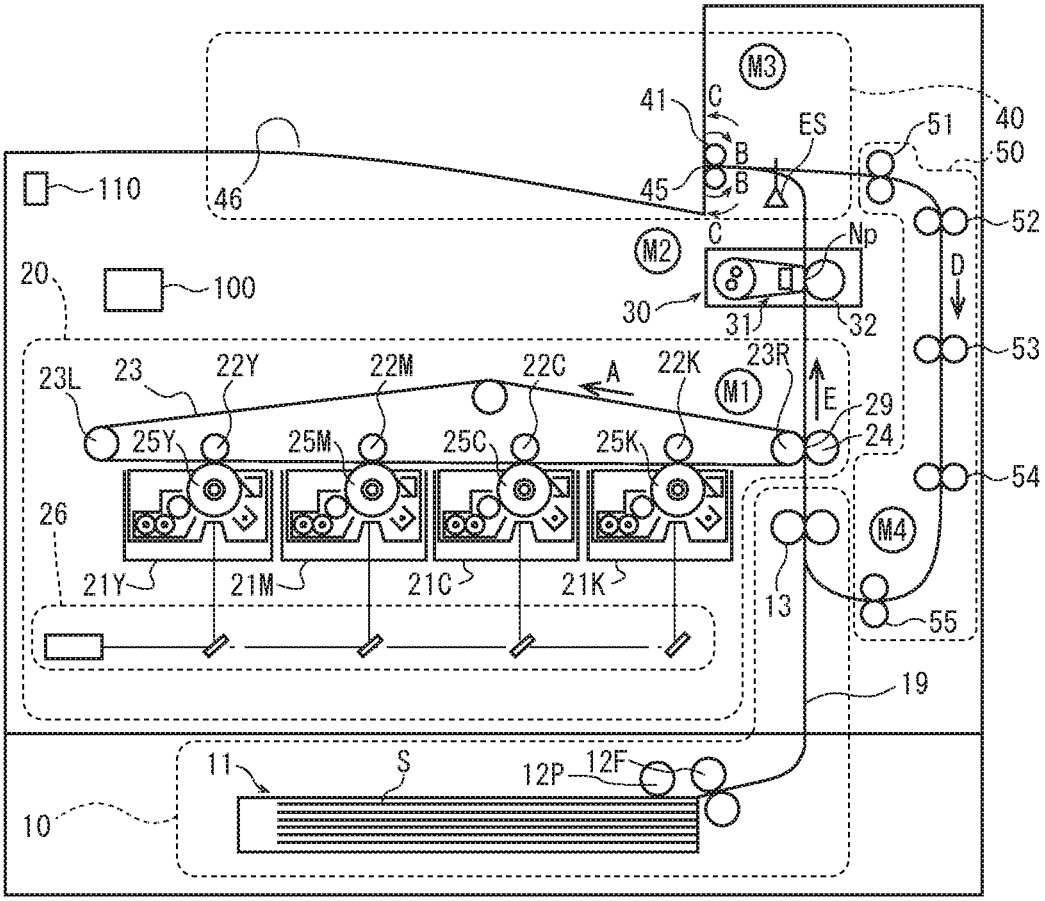
FIG. 1 is a schematic diagram illustrating an overall structure of a printer pertaining to Embodiment 1.

FIG. 1 is a schematic cross-section diagram illustrating an overall structure of a printer 1.

As illustrated, the printer 1 uses an electrophotographic system, includes a feeding section 10, an imaging section 20, a fixing section 30, an ejecting section 40, and a double-sided conveying section 50, and can execute single-sided print jobs that print an image on only one side (front side) of a sheet S and double-sided print jobs that print images on both sides (front side and back side) of a sheet S.

The feeding section 10 includes a sheet feed tray 11 that accommodates sheets S, a feeding roller 12P provided to the sheet feed tray 11 that feeds out the sheets S one by one to a conveyance path 19, a sheet feed roller 12F that conveys fed out sheets S, a timing roller 13 for timing feeding of sheets S to a secondary transfer position 29, and the like.

The imaging section 20 forms a toner image on a sheet S fed from the feeding section 10. More specifically, in four imaging units 21Y, 21M, 21C, 21K, surfaces of charged photosensitive drums 25Y, 25M, 25C, 25K are exposed to laser light from an exposure unit 26 that is modulated and driven based on image data to form electrostatic latent images on the surfaces, and the electrostatic latent images are developed with toners in yellow (Y), magenta (M), cyan (C), and black (K) colors.

The four color toner images realized by developing are transferred onto a surface of an intermediate transfer belt 23 from each of the photosensitive drums 25Y, 25M, 25C, 25K due to an electric field between the photosensitive drums 25Y, 25M, 25C, 25K and primary transfer rollers 22Y, 22M, 22C, 22K via the intermediate transfer belt 23. In this transfer, toner image forming timing is staggered in the imaging units 21Y, 21M, 21C, 21K so that toner images of each color Y, M, C, K are transferred to the same position on the intermediate transfer belt 23. As a result, a color toner image is formed by overlapping transfer of Y, M, C, K color toner images onto the intermediate transfer belt 23.

The intermediate transfer belt 23 is disposed above the photosensitive drums 25Y, 25M, 25C, 25K, is kept taut across a plurality of rollers including a driving roller 23R and a driven roller 23L, and travels in the direction of an arrow A. The color toner image on the intermediate transfer belt 23 moves due to travel of the intermediate transfer belt 23 to a secondary transfer position 29, which is a contact position between the intermediate transfer belt 23 and a secondary transfer roller 24.

The color toner image on the intermediate transfer belt 23 is transferred to a surface (first surface) of the sheet S at the secondary transfer position 29 by an electrical field between the intermediate transfer belt 23 and the secondary transfer roller 24 as the sheet S conveyed from the feeding section 10 passes between the intermediate transfer belt 23 and the secondary transfer roller 24. The sheet S on which the color toner image has been transferred is conveyed in the direction of an arrow E by the secondary transfer roller 24 towards the fixing section 30.

The fixing section 30 includes a fixing belt 311 (heated rotating body) and a pressure roller 32 (pressure member), and a toner image is thermally fixed on the sheet S by the sheet S passing through a nip Np formed between the fixing belt 311 and the pressure roller 32.

The ejecting section includes an ejection roller 41 and an ejection port 45, and ejects the sheet S on which the color toner image is fixed from the ejection port 45. The ejection roller 41 is disposed inside of the ejection port 45, and while rotating in a direction of the arrow B (forward rotation) conveys the sheet S conveyed from the fixing section 30 outside the device to eject the sheet S from the ejection port 45. The ejected sheet S is stored on an ejection tray 46. Thus, a single-sided print of only the first surface of the sheet S is completed.

Further, in the case of a double-sided print job, the sheet S that has passed through the secondary transfer position 29 for printing on the front surface (first surface) is conveyed from the fixing section 30 to the ejection roller 41. When a rear end of the sheet S conveyed by the ejection roller 41 in the conveyance direction passes through a detection position of an ejection sensor ES that is an optical sensor, the ejection roller 41 switches from forward rotation to reverse rotation (rotation in the direction of the arrow C).

Due to the reversal of the ejection roller 41, the sheet S changes direction and is guided to the double-sided conveying section 50, where double-sided conveyance rollers 51, 52, 53, 54, 55 convey the sheet S along a double-sided conveyance path in the direction of the arrow D to the secondary transfer position 29 via the timing roller 13, where a color toner image is transferred to a back surface (second surface) of the sheet S. After thermal fixing at the fixing section 30, the sheet S is ejected to the ejection tray 46 by the ejection roller 41.

In the feeding section 10 and the imaging section 20, rotating members including conveyance rollers, the drive roller 23R, and the photosensitive drums 25Y, 25M, 25C, 25K are rotated by a drive force of a drive motor M1 disposed in the imaging section 20. Further, the pressure roller 32 of the fixing section 30 is rotationally driven by a drive motor M2 (fixing motor), the ejection roller 41 is rotationally driven forwards and backwards by a drive force of a drive motor M3 disposed in the ejecting section 40, and the double-sided conveyance rollers 51, 52, 53, 54, 55 are rotated by a drive force of a drive motor M4 disposed in the double-sided conveying section 50.

Further, a controller 100 is connected to an external terminal device via a network (not shown) through a network interface (I/F) 110, receives print job data transmitted from the terminal device, generates image data to be printed from the received print job data, and uses the generated image data for printing.

(2) Fixing Section Structure

Figure 2:
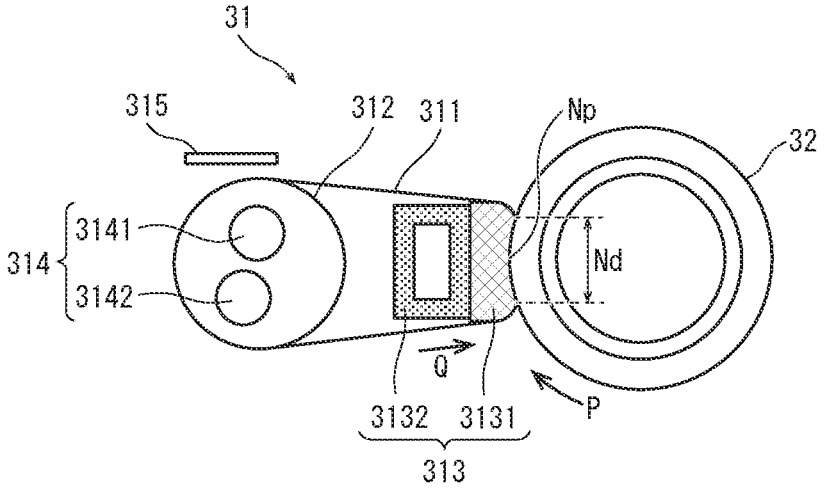
FIG. 2 is a cross-section diagram illustrating a schematic structure of a fixing section of the printer.

FIG. 2 is a schematic cross-section diagram illustrating structure of the fixing section 30.

As illustrated, the fixing section 30 includes a heating unit 31 and the pressure roller 32. The heating unit 31 includes an endless fixing belt 311, a heating roller 312 (heating unit) and a fixing member 313 that tension the fixing belt 311, a heater 314 that applies heat to the heating roller 312, and a temperature sensor 315 for detecting temperature of the fixing belt 311.

The fixing belt 311 has a layered structure including an elastic layer made of a highly heat-resistant material such as silicone rubber or fluororubber on a base layer made of a material such as polyimide or stainless steel, and a release layer having releasability made of a fluororesin such as perfluoroalkoxy alkane resin (PFA).

The heating roller 312 includes a coating layer made of polytetrafluoroethylene (PTFE) on an outer circumferential surface of a cylindrical aluminum hollow core metal, and both ends in an axial direction of the cylinder are supported to be freely rotatable by a frame (not shown) of a housing of the fixing section 30.

The heater 314 is inserted into the space in the inner circumferential side of the cylindrical heating roller 312, and includes a first heater 3141 that heats almost an entire range of the heating roller 312 in the axial direction thereof (longitudinal direction: perpendicular to the paper surface in FIG. 2) and a second heater 3142 that heats a central portion of the heating roller 312 in the axial direction. Heat is generated by a power supply from a power source (not shown), heating the heating roller 312. According to the present embodiment, the first heater 3141 and the second heater 3142 are halogen heaters, but may be other heat sources.

The fixing member 313 includes a resin pad 3131 in contact with a back surface of the fixing belt 311 and a support member 3132 that supports the resin pad 3131. A lubricant for reducing friction is applied at a sliding contact surface between the fixing belt 311 and the resin pad 3131. The support member 3132 is fixed to a frame (not shown) of the fixing section 30.

The pressure roller 32 is a layered structure including an elastic layer made of a material such as silicone rubber and a release layer made of a material such as PFA on an outer circumferential surface of a cylindrical metal core made of a material such as aluminum or iron. Both ends of the pressure roller 32 in the axial direction of the pressure roller 32 are supported by the frame to be freely rotatable, and a circumferential surface of the pressure roller 32 is pressed against the circumferential surface of the fixing belt 311 at a defined load (pressure contact force) by a force from an elastic member (not shown) such as a spring. According to this pressure contact, the nip Np is formed between the outer circumferential surface of the pressure roller 32 and the outer circumferential surface of the fixing belt 311.

The pressure roller 32 is rotationally driven at a defined rotation speed in a direction indicated by the arrow P by a rotational drive force of the fixing motor M2 (see FIG. 1). Due to the rotation of the pressure roller 32, the fixing belt 311 tensioned by the heating roller 312 and the fixing member 313 is rotated (travels) in the direction of the arrow Q. According to at least one embodiment, the heating rotating body drives rotation instead of the pressure rotating body, and the pressure rotating body is driven.

When a fixing job is executed, rotation speed of the fixing motor M2 is controlled so that conveyance speed of the sheet S passing through the nip Np is kept steady at a defined system speed (reference speed).

When an electrical current is applied across the heater 314 during travel of the fixing belt 311, heat generated from the heater 314 is transmitted from the heating roller 312 (heater) to the fixing belt 311, and reaches the nip Np due to travel of the fixing belt 311.

As a result, heat of the fixing belt 311 is supplied to the pressure roller 32 and the fixing member 313, and temperature of the nip Np, which is a contact region between the fixing belt 311 and the pressure roller 32, rises.

The temperature sensor 315 is, for example, a thermistor, is disposed near a portion of the fixing belt 311 in contact with an outer circumferential surface of the heating roller 312, detects a surface temperature of the fixing belt 311, and outputs a detection result to the controller 100.

Based on the detection result, the controller 100 turns on or off electric power supplied to the first heater 3141 and the second heater 3142 in the heater 314, to control towards a target temperature for the fixing belt 311.

More specifically, for example, if a temperature detected by the temperature sensor 315 is Tw, the position of the temperature sensor 315 and the nip Np are separated by a defined distance, and therefore a temperature TN at the nip Np is not the detected temperature Tw but a corrected value reached by multiplying Tw by a constant adjusted temperature correction coefficient A1, where A1 is less than 1, then $TN=A1\times Tw$.

Accordingly, the controller 100 turns the heaters 3141, 3142 in the heater 314 on and off so that the temperature TN after correction becomes equal to a target set temperature.

A temperature control that raises the temperature of the nip Np to a target temperature at which fixing can occur (warm-up control) is executed when power is turned on to the device, after maintenance by a user in response to a jam occurrence, after closing a maintenance-use front panel or the like, when returning from a low power consumption sleep mode, and so on.

According to this warm-up control, the first heater 3141 (long heater) is turned on in order to quickly raise the temperature to one at which fixing can occur. For example, if the target set temperature TN for fixing is 155° C., this value of TN is input, and the first heater 3141 is controlled to turn on and off such the heated roller 312 reaches a target heating temperature (TN/A1: for example, 170° C.), and the nip Np is heated by rotation of the fixing belt 311 at a defined travel speed (linear speed; for example, 135 mm/s)

After warm-up is completed, a print job is executed by switching to a heating control according to the second heater 3142 (short heater). Subsequently, if there is no print instruction, the target set temperature of the heating roller 312 is set by the first heater 3141 to a standby temperature lower than when a fixing job is executed (about 150° C. to 155° C.), and after idling rotation is executed for a defined time with this temperature control, the fixing belt 311 is stopped in a transition to a standby mode. During this time, the heating roller 312 is maintained at the standby temperature.

When a large amount of small-sized sheets are output in a print job, only heat in the central portion of the axial direction is taken away and temperature at the ends in the axial direction may rise excessively, and therefore in addition to the temperature sensor 315 that detects temperature of the central portion in the axial direction (scanning direction), a temperature sensor that detects temperature of an axial end portion may be provided to switch heating between the first heater 3141 and the second heater 3142 as appropriate, in order that axial end portion temperature does not rise excessively.

(3) Stick-Slip Conditions

The following considers conditions for occurrence of stick-slipping in the nip Np of the fixing section 30.

Figure 3:
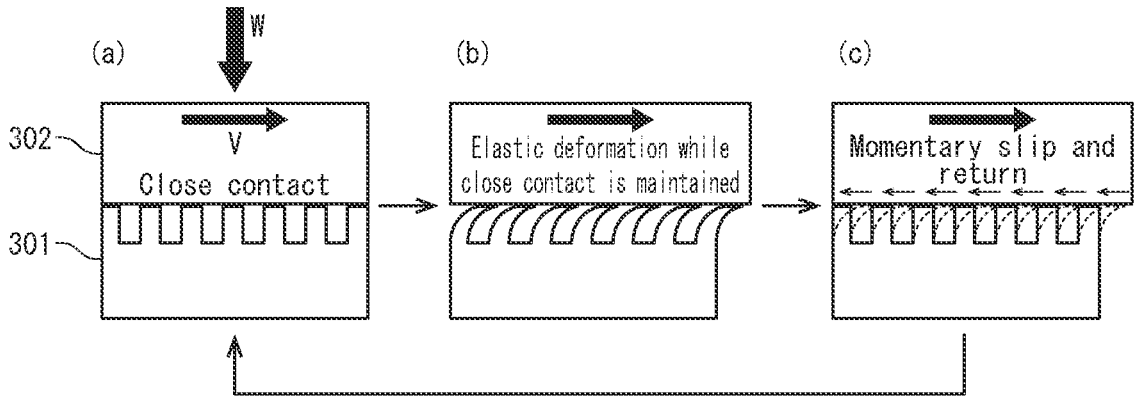
FIG. 3 is a model diagram for explanation of a mechanism of stick-slip generation.

FIG. 3 is a generic model diagram for explanation of a mechanism of stick-slip generation.

As illustrated, a second member 302 (corresponding to the pressure roller 32 of the present embodiment) is pressed against an elastic first member 301 (corresponding to the fixing belt 311 of the present embodiment) with a load W. The second member 302 is then moved at a velocity V in the direction indicated by an arrow (see FIG. 3(*a*)).

Under the load W, upper surfaces of the first member 301 and a lower surface of the second member 302 are initially in a stuck state, and as the second member 302 moves in a horizontal direction, a surface layer of the first member 301 is elastically deformed (see FIG. 3(*b*)).

Then, when an elastic restoring force of the surface layer of the first member 301 exceeds a static friction force with the lower surface of the second member 302, a slip occurs between the surface layer of the first member 301 and the lower surface of the second member 302, causing the surface layer of the first member 301 to return to its original shape (see FIG. 3(*c*)). At this time, stick-slip noise is generated.

The behavior illustrated in FIG. 3(*a*)(*b*)(*c*) is repeated.

In such a model case, a parameter λ indicating susceptibility to stick-slipping can be expressed as follows:

$$\lambda = \frac{\Delta\mu W}{(mk)^{1/2} V} \qquad \text{Expression (1)}$$

In Expression (1), $\Delta\mu = \mu s - \mu k$. Here, μs is the coefficient of static friction between the first member 301 and the second member 302, μk is the coefficient of dynamic friction between the first member 301 and the second member 302, W is the load applied from the second member 302 to the first member 301, m is the mass of the second member 302, k is the spring rigidity coefficient (modulus of rigidity), and V is initial velocity of the second member 302.

It is known that the smaller the value of the parameter λ in Expression (1), the less likely it is that stick-slipping will occur. When Expression (1) is applied to analysis of stick-slipping in the nip Np of the fixing section 30, the following points become apparent.

(a) The larger the total number of prints send to the fixing section 30 (total number of sheets passing through) and/or total travel distance, the larger Δμ is.

Normally, in the fixing section 30, an outer surface of a rotating body that comes into contact with toner (in the present embodiment, the outer surface of the fixing belt 311) is coated with a fluorine-based resin or the like in order to improve releasability of the toner.

As the number of prints and travel distance increase, the coating on the outer surface of the fixing belt 311 gradually wears away, and the coefficient of friction of the surface of the fixing belt 311 gradually increases.

At this time, both the coefficient of static friction μs and the coefficient of dynamic friction μk increase, but it is empirically known that the rate of increase of the coefficient of static friction μs is larger than the rate of increase of the coefficient of dynamic friction μk, and therefore the value of Δμ tends to increase with time.

Since Δμ cannot be directly measured in the image forming device, according to the present embodiment the total number of prints and/or total travel distance is used as an index value to index the value of Δμ.

(b) Normally, the rigidity k of an elastic body has a property of decreasing as the amount of heat storage increases (i.e., elasticity increases).

This rigidity is a physical property that determines the difficulty of deformation by a shearing force, and elastic material such as rubber used for the nip forming rotating bodies of the fixing section 30 is known to decrease in rigidity as temperature increases.

As a condition for stick-slip generation, rigidity of elastic material at contact surfaces between the first member 301 and the second member 302 becomes a problem, but when rigidity is indexed by temperature, temperature of just the surface is insufficient, and warming of an entire portion forming the nip (hereinafter also referred to as "nip forming members" and "heat stored") is an important parameter.

According to the present embodiment, the fixing member 313 (in particular the resin pad 3131), the pressure roller 32, and the fixing belt 311 are included as the nip forming members.

Accordingly, the larger the heat stored in the nip forming members in the fixing section 30, the smaller the rigidity.

In consideration of Expression (1) and points (a) and (b), it can be seen that stick-slipping is more likely to occur as the total number of printed sheets (or total travel distance) increases, or as the heat stored in the nip forming members increases.

(4) Acquisition of Index Values (4-1) Index Value of Change of Δμ

As described above, an amount of change of Δμ correlates with the total number of sheets printed and/or total travel distance, and therefore these can be used as index values.

Here, the total number of prints means the cumulative number of prints from a new image forming device first being activated or from replacement of a fixing unit with a new one to the most recent printing (in other words, the cumulative number of sheets passed through the nip Np in fixing jobs).

According to the present embodiment, as a general rule, the number of prints onto standard A4 size sheets passing through the fixing section widthwise is counted. When printing on other sheet sizes, a number of sheets may be calculated by conversion into A4 sheets by area ratio, or each sheet may be counted as one sheet if there is not much difference in size.

Total travel distance can be obtained by multiplying the circumference of the pressure roller 32 by a cumulative number of rotations of the pressure roller 32 from a new image forming device first being activated or from replacement of a fixing unit to the most recent printing.

In the following, the total number of printed sheets and/or total travel distance may be referred to as a "duration index value" or "first index value".

(4-2) Index Value of Change of Rigidity

Rigidity of elastic layers for forming the nip Np can be estimated from heat stored in the entirety of the nip forming members as described above (warming condition). Rigidity is not an absolute value, but changes are considered to be an index.

However, the amount of heat stored in the nip forming members cannot be actually measured in the device, and therefore it is necessary to set a parameter (first parameter) to quantitatively estimate this value.

Thus, the inventors of the present application considered that traveling time of the fixing belt 311 subjected to heating control via the heating roller 312 (hereinafter also referred to as "belt rotation time") is one reference for evaluating heat stored in the nip forming members.

This is because heat applied to the fixing belt 311 by the heating roller 312 is eventually propagated to the fixing member 313, the pressure roller 32, and the like due to rotation of the fixing belt 311, and this affects warming of the nip forming members.

According to the present embodiment, the belt rotation time for one fixing job, as a general rule, is not only rotation time for fixing a sheet passing through the nip Np (a fixing job in a narrow sense), but also includes idling rotation time during warm-up before fixing job execution and idling rotation time after fixing job execution (a fixing job in a broad sense).

This is because heat supplied by the heating roller 312 is supplied to the nip Np via the fixing belt 311 through rotation of the fixing belt 311 even during idling rotation before and after such a fixing job.

Strictly speaking, heat per unit time supplied to the fixing belt 311 from the heating roller 312 is different for each of (i) pre-processing idling rotation, (ii) fixing job execution (in the narrow sense), and (iii) post-processing idling rotation, but it can be considered that on average, a uniform amount of heat is supplied per unit time over the entire belt rotation time.

However, it is considered that the set temperature at the time of executing a fixing job in the narrow sense is highest, and influence on heat stored in the nip forming members is correspondingly large, and therefore the fixing job execution time in the narrow sense may be selectively measured as the belt rotation time.

In the following description, for convenience, idling rotation during warm-up before executing a fixing job is referred to as "pre-processing idling rotation", and idling rotation after executing a fixing job is referred to as "post-processing idling rotation". Further, unless otherwise specified, "fixing job" means a fixing job in the narrow sense described above.

Post-processing idling rotation is stopped after a preset time and shifts to the standby mode, but during this standby mode, temperature of the heating roller 312 is maintained at a temperature (standby temperature) that allows it to reach the fixing temperature soon after accepting the next print job.

According to the present embodiment, the standby temperature is set to be about 10° C. to 30° C. lower than the heating temperature of the heating roller 312 during fixing job execution.

The following is a description of an index value of heat stored in the nip forming members at the start of post-processing idling rotation (second index value).

At the timing of a start of post-processing idling rotation, an immediately preceding belt rotation time Tr (excluding post-processing idling rotation) when an immediately preceding fixing job was executed (hereinafter also referred to as an "immediately preceding job") is the index that has the greatest effect on heat stored in the nip Np.

However, there is a high possibility that an amount of heat applied from a fixing job executed prior to the immediately preceding job (hereinafter also referred to as a "prior job") also remains.

According to the present embodiment, a residual heat storage from the prior job is indicated by a corrected rotation time Tδ obtained by converting the belt rotation time of the prior job to an immediately preceding belt rotation time, and a total rotation time R is obtained by adding the corrected rotation time Tδ to the belt rotation time Tr of the immediately preceding job (R=Tr+Tδ), and this is used as a first parameter for indexing heat stored in the nip forming members.

The corrected rotation time Tδ can be obtained based on a correction of the belt rotation time of the prior job in consideration of a length of a subsequent stop time.

The inventors of the present application focused on an amount of change in width Nd (nip width, see FIG. 2) of the nip Np in the sheet conveyance direction in order to obtain the corrected rotation time Tδ that indicates the residual heat storage from the prior job.

Specifically, the greater an amount of heat stored in the nip forming members, the greater the thermal expansion of the pressure roller 32, and the greater the thermal expansion of the pressure roller 32, the greater the nip width Nd, which is the length of contact with the fixing belt 311 in the sheet conveyance direction.

Thermal expansion of the pressure roller 32 varies depending on an amount of heat applied from the heated fixing belt 311 to the pressure roller 32, and the amount of heat applied to the pressure roller 32 differs depending on whether the fixing belt 311 is rotating or stopped.

The heating roller 312 heated by the heater 314 heat source and the pressure roller 32 that forms the nip Np are separated from each other, and therefore if the fixing belt 311 rotates as when printing, heat of the heating roller 312 heated by the heater 314 is directly transferred from the fixing belt 311 to the nip Np.

However, if the fixing belt 311 is stopped such as when waiting for a print job, heat transferred from the heating roller 312 to the distant nip Np is greatly reduced.

Figure 4:
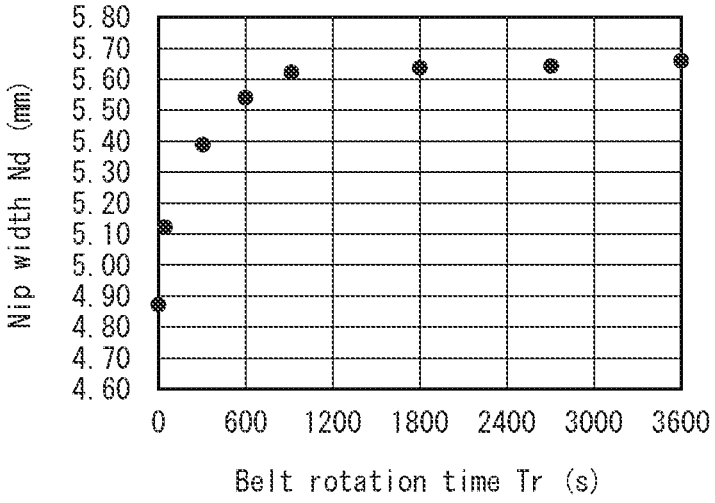
FIG. 4 is a graph illustrating a relationship between fixing belt rotation time and nip width changes.
Figure 5:
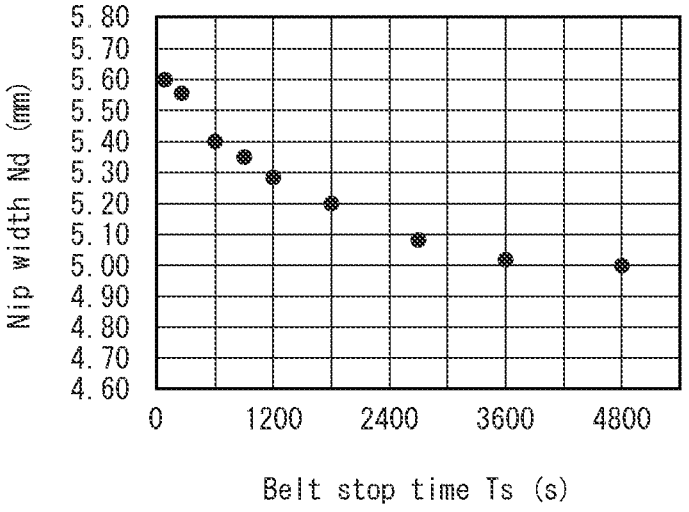
FIG. 5 is a graph illustrating a relationship between fixing belt stopping time and nip width changes.

The nip width Nd varies as illustrated in FIG. 4 and FIG. 5, depending on whether the fixing belt 311 is rotating or stopped. FIG. 4 illustrates a relationship between belt rotation time (in seconds) of the fixing belt 311 and the nip width Nd (in millimeters) while temperature of the nip Np is controlled to become a high temperature equal to or more than a defined value (for example, at least 100° C.) by application of a defined amount of heat from the heating roller 312 to the fixing belt 311 (hereinafter also referred to as "during heating control").

Further, FIG. 5 illustrates a relationship between stop time of the fixing belt 311 (fixing belt stop time Ts) and nip width Nd after heat is stored due to rotation of the fixing belt 311.

FIG. 4 and FIG. 5 illustrate examples of actual measurements of the relationships between the belt rotation time Tr, the fixing belt stop time Ts, and the nip width Nd.

As shown in FIG. 4, the nip width Nd increases as the belt rotation time Tr increases. More specifically, the nip width Nd was 4.85 mm at the start of rotation of the fixing belt 311, but after 300 s, the nip width Nd became 5.4 mm, and after 900 s, the nip width Nd expanded to 5.6 mm.

When rotation of the fixing belt 311 is stopped from this state, an amount of heat transferred to the pressure roller 32 decreases, and therefore as the fixing belt stop time Ts increases, the nip width Nd becomes narrower, as shown in FIG. 5. Specifically, the nip width Nd, which was 5.6 mm when the fixing belt 311 was stopped, became 5.4 mm after 600 s, and narrowed to 5.2 mm after 1800 s.

In FIG. 5, the nip width Nd does not return to the original size of 4.8 mm because even when rotation of the fixing belt 311 is stopped, heat from the heating roller 312 is transmitted via the stopped fixing belt 311 to the pressure roller 32, and heat radiated from the heating roller 312 is also radiated to the pressure roller 32.

Note that the above-mentioned size of the nip width Nd is an example, and of course size of the nip width Nd may differ depending on the structure of the fixing section 30.

In this way, the nip width Nd increases according to the rotation time of the fixing belt 311 heated by the heater 314, and decreases according to the stop time of the fixing belt 311.

As rotation time of the fixing belt 311 increases, the amount of heat supplied to the nip forming members via the nip Np increases, and therefore heat stored in the nip forming members increases accordingly. Following on from this, the longer the stop time of the fixing belt 311, the less heat is stored in the nip forming members due to dissipation, and therefore it can be said that the heat stored in the nip forming members has a clear correlation with the fixing belt rotation time and stop time.

Figure 6:
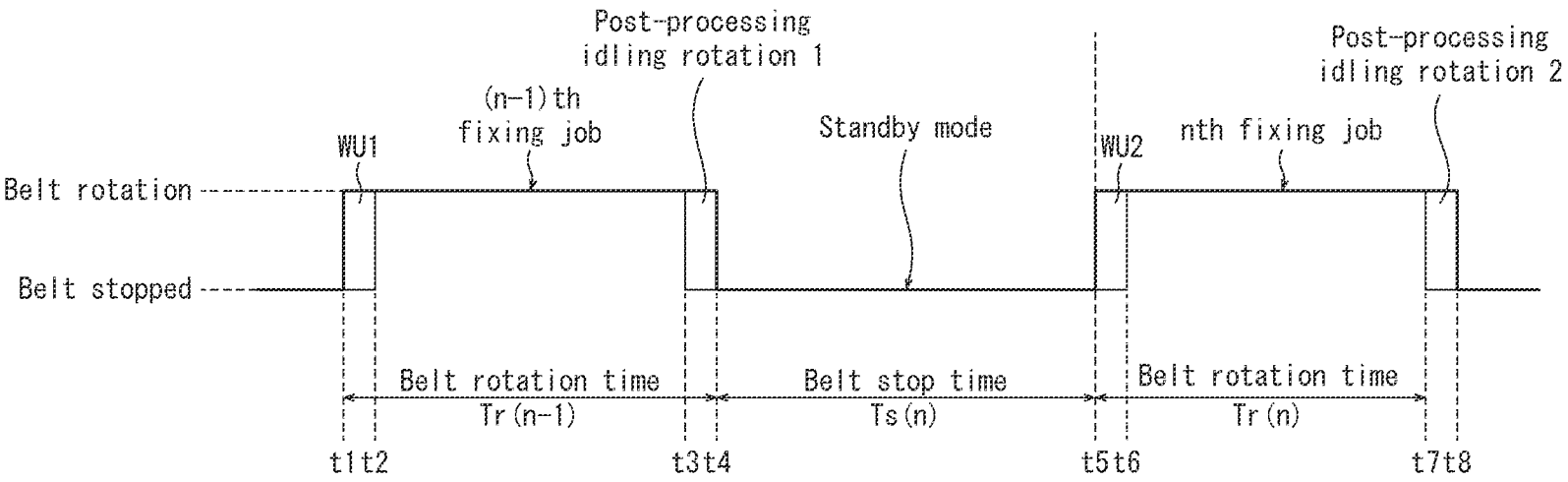
FIG. 6 is a time chart for explaining fixing job execution and states of fixing belt rotation and stopping.

FIG. 6 is a time chart illustrating an example of rotation/stop operations of the fixing belt 311 for fixing jobs executed for (n−1)th and nth print jobs received at defined times. Note that "n" is a natural number, and in this example, is initialized as "1" for a print job immediately after power is turned on, and increments by 1 for each subsequent print job.

First, when an execution start instruction for an (n−1)th print job is received (time t1), a warm up wu1 (preprocessing idling rotation) is started, and when the nip Np reaches the defined fixing temperature (time t2), the (n−1)th fixing job is executed to thermally fix an unfixed toner image to a sheet in the (n−1)th print job.

When the (n−1)th fixing job is completed (time t3), post-processing idling rotation 1 is executed to diffuse heat in the nip Np, after which rotation of the fixing belt 311 is stopped at time t4 and the standby mode is transitioned to.

Next, a warm up wu2 is started (time t5) at the start of execution of the nth print job n, then execution of the nth fixing job is started at time t6, and on completion (time t8), after executing post-processing idling rotation 2, rotation of the fixing belt 311 is stopped at time t8, and the standby mode is transitioned to.

Here, when determining the necessity of changing the conditions for idling rotation (set temperature and idling rotation time) in the post-processing idling rotation 2 at time t7, as an index of the heat stored in the nip forming members at this time, the belt rotation time when executing the immediately preceding fixing job (n) (Tr(n)=t7−t5) has the greatest effect, but in order to more accurately reflect the heat stored, it is desirable to take into consideration residual heat remaining in the nip Np from execution of the prior fixing job.

After the fixing job is completed, upon entering the fixing belt stop time, then as illustrated by FIG. 5, the nip width Nd becomes smaller as heat is dissipated according to the fixing belt stop time, and therefore it is not desirable to add the belt rotation time Tr(n−1) of the prior fixing job (n−1) uncorrected to the belt rotation time Tr(n) as an index of heat stored, and some correction is required.

Figure 7:
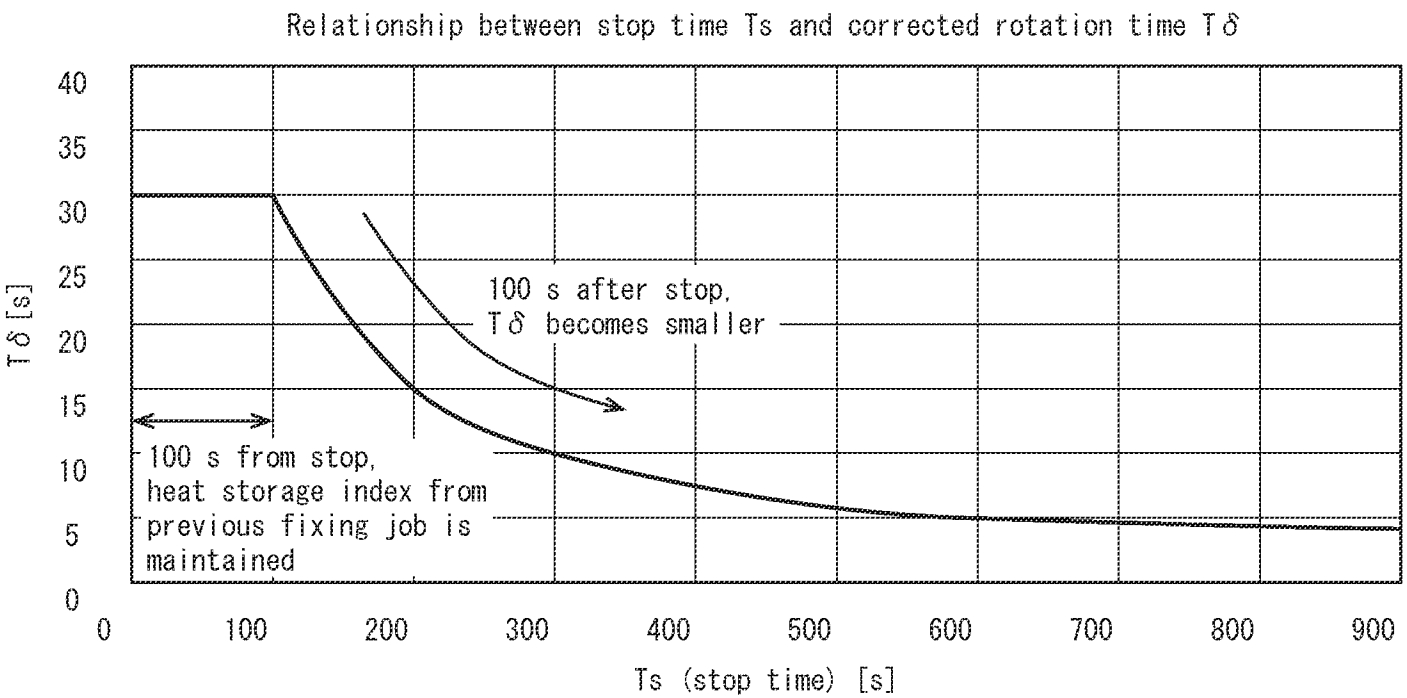
FIG. 7 is a graph illustrating correlation between a corrected rotation time Tδ and a stopping time Ts of the fixing belt.

FIG. 7 is a graph in which the horizontal axis indicates the fixing belt stop time Ts, and the vertical axis indicates a corrected rotation time Tδ. The value of the corrected rotation time Tδ is calculated by converting changes to nip width Nd over fixing belt stop time Ts into a value indicating the belt rotation time of the immediately preceding job, where the changes to nip width Nd are obtained from the experimental results shown in FIG. 5, assuming a belt rotation time Tr(n−1) of the immediately preceding fixing job (n−1) is 30 seconds.

According to experiments, almost no change in nip width Nd was observed for about 100 seconds after rotation of the fixing belt 311 was stopped, and therefore as illustrated in FIG. 7, until the stop time Ts reaches 100 seconds, the corrected rotation time Tδ does not change from 30 seconds, but when the stop time Ts exceeds 100 seconds, the corrected rotation time Tδ gradually decreases.

Figure 11:
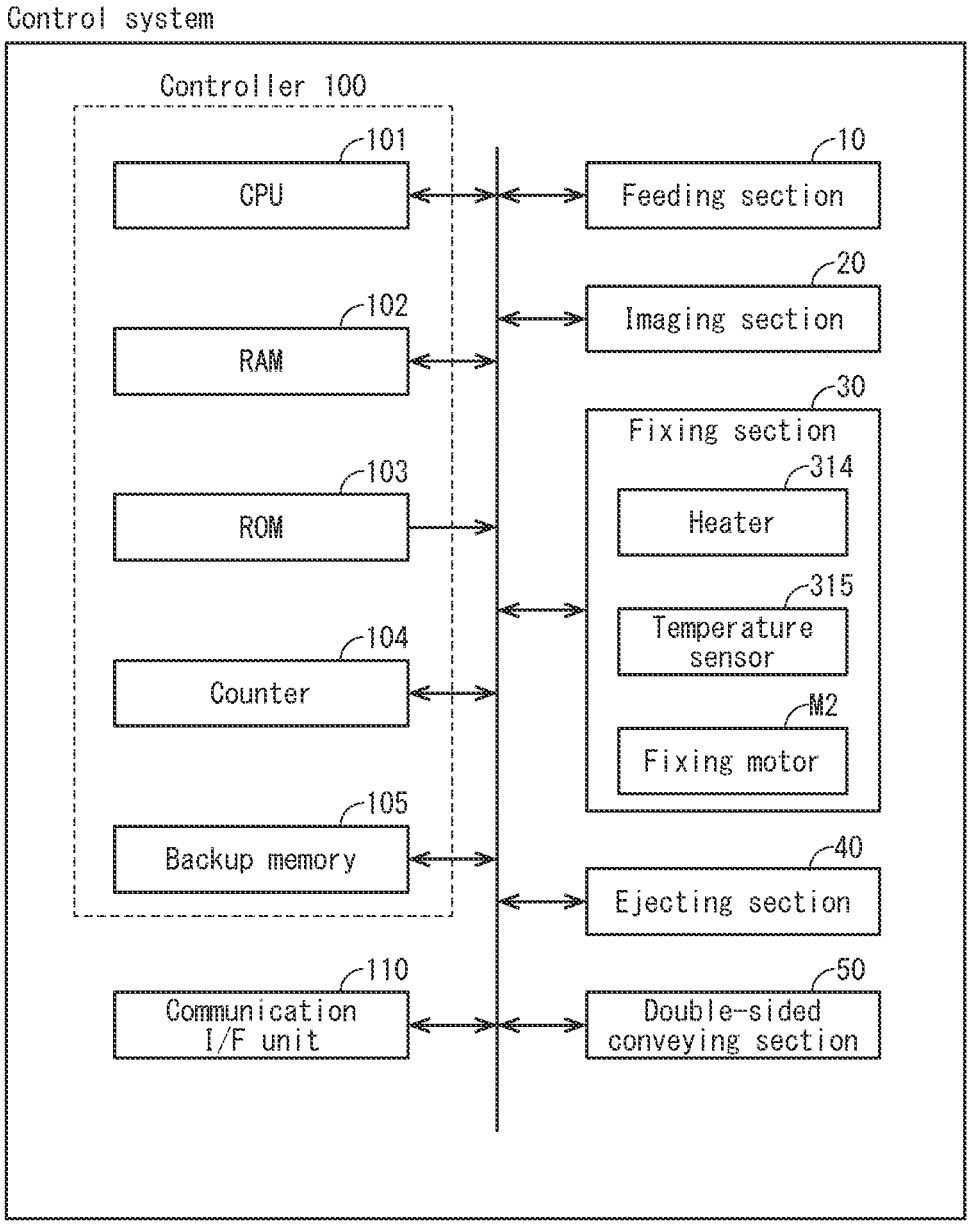
FIG. 11 is a block diagram illustrating a printer control system.

Such correlation between the corrected rotation time Tδ and stop time Ts is obtained in advance for each value of rotation time indicating heat storage at the time rotation stops, and is converted into, for example, a conversion table (first table) and stored in a read-only memory (ROM) 103 (see FIG. 11).

When R(n−1) is the belt rotation time that indicates an amount of residual heat at the end of the previous (n−1)th fixing job, and after attenuation across the subsequent fixing belt rotation stop time Ts(n), residual heat is indicated by the corrected rotation time Tδ(n), then from the above experimental results, Tδ(n) can be approximated by the following Expression (2) (first arithmetic expression):

$$T\delta(n) = R(n-1) * \left(1 - \frac{Td(n)}{Td(n) + \beta}\right) \qquad \text{Expression (2)}$$

Here, Td(n) is time that substantially contributes to attenuation of residual heat storage from the fixing belt rotation stop time Ts(n) immediately preceding execution of the nth fixing job (hereinafter also referred to as "attenuation contributing time").

Based on the experimental results mentioned above, the nip width Nd did not change for 100 seconds after rotation was stopped, and therefore the attenuation contributing time Td(n) is as follows:

When Ts(n) is greater than 100, Td(n)=Ts(n)−100.

When Ts(n) is equal to or less than 100, Td(n)=0.

Further, β is a positive constant for determining the degree of attenuation, and varies depending on structure of the fixing section 30, the structure, material, and the like of the fixing roller, the fixing belt, the pressure roller, and the like. A specific value for β is obtained by experimentation.

Accordingly, when the belt rotation time R(n) is an index for stored heat (residual stored heat) in the nip Np after completion of an nth fixing job, R(n) can be obtained by summing the belt rotation time Tr(n) upon completion of the nth fixing job and the corrected rotation time Tδ(n) that is a conversion of residual heat remaining in the nip Np from the prior fixing job into value indicating a rotation time of the immediately preceding nth fixing job.

$$R(n)=Tr(n)+T\delta(n) \qquad \text{Expression (3)}$$

Substituting Expression (2) into Expression (3) results in Expression (4):

$$R(n) = Tr(n) + R(n-1) * \left(1 - \frac{Td(n)}{Td(n)+\beta}\right) \qquad \text{Expression (4)}$$

As described above, n is a natural number (1, 2, 3, . . . ) that normally indicates an order of print jobs executed after the device is powered on in the morning.

Note that when the stop time from the end of the (n−1)th fixing job to the start of execution of the nth fixing job is very long, equal to or more than a defined threshold value (for example, 2 hours), residual heat from the prior fixing job is almost entirely dissipated and can be ignored. In such a case, n may be reset to 1, and R(0) regarded as 0.

Further, even in a case where sleep mode time (non-heating control time) for power saving is long and heat dissipation of the nip forming members progresses, temperature of the heating roller 312 also decreases, and therefore when temperature of the heating roller 312 as detected by the temperature sensor 315 is a defined temperature (for example, 50° C.), n may be reset to 1.

On the other hand, even if power to the main body of the device is turned off, the controller 100 continues the count of the rotation stop time, and when the power is turned on, unless the stop time to the start of execution of the next fixing job is equal to or more than the threshold value above, n is not reset, and the total rotation time R(n) (first parameter) can be obtained, indicating heat stored in the nip Np taking into consideration residual heat from before the power was turned off.

Further, values of Tr(n) and Td(n) are counted by a counter 104 in the controller 100 (see FIG. 11) and stored in a backup memory 105 at a defined timing (first timing) (for example, for Tr(n), at the end of the nth fixing job or when post-processing idling rotation is stopped, and for Td(n), at the start of warm-up of a next fixing job, for Ts(n), Tδ(n), at a time of transition from a rotation stopped state to rotation start), and when backed up, the count by the counter 104 is reset. Each of the above counter values are backed up so that even when power of the printer is suddenly cut off, the history of the counter values is not lost.

Figure 8:
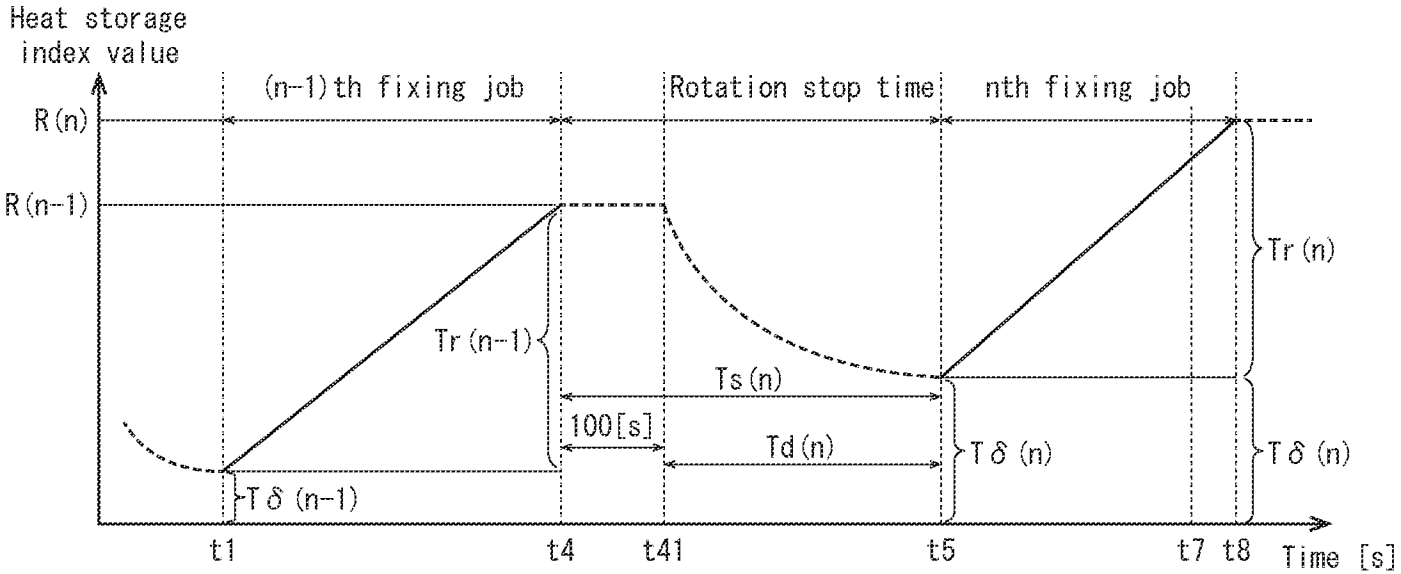
FIG. 8 is a graph illustrating changes in an index value of heat stored when the fixing belt is rotated again after a stop time elapses after a previous rotation of the fixing belt.

FIG. 8 is a graph illustrating change in an index value R of heat stored in the nip Np when (n−1)th and nth fixing jobs are executed as illustrated in FIG. 6, where the vertical axis is R seconds as an index value of heat stored and the horizontal axis is elapsed time in seconds.

The (n−1)th fixing job is executed from time t1, but at this point, the corrected rotation time Tδ(n−1), which indicates residual heat generated by the (n−2)th or earlier fixing job is added to the gradually increasing belt rotation time of the (n−1)th fixing job (by the broad definition), and at time t4 when rotation stops, the index value R(n−1) is equal to Tr(n−1)+Tδ(n−1).

Subsequently, after rotation stop time passes and execution of the nth fixing job is started at time t5, the belt rotation time Tr(n) of the nth fixing job is gradually added to the corrected rotation time Tδ(n).

Thus, the index value R(n)=Tr(n)+Tδ(n) is obtained, indicating heat stored in the nip Np at the end of the nth fixing job. The corrected rotation time Tδ(n) is obtained from Expression (2).

In this way, an index value of heat stored in the nip forming members is basically obtained by summing a history of rotation times of the fixing belt 311 in fixing jobs executed up until the immediately preceding fixing job, and when there is a stop time of the fixing belt 311 between a prior job and a next job, then depending on the length of the stop time (attenuation contributing time), the sum of the rotation time until that point is corrected then added, and therefore an index value (hereinafter also referred to as "heat storage index value") that better reflects actual heat stored in the nip forming members can be obtained.

(5) Determining Target Set Temperature and Idling Rotation Time for Idling Rotation As described above, the heat storage index value R(n) of the nip forming members at the end of a fixing job in the broad sense can be obtained from a history of rotation time of the fixing belt 311, and from this it is possible to determine the probability of stick-slip sound being generated when idling rotation is stopped.

As described above, the parameter λ (see Expression (1)) indicating probability of stick-slip occurrence increases as the rigidity k of the member forming the nip decreases, and this is because of the correlation that the larger the heat storage of the member forming the nip (the larger the heat storage index value R(n)), the smaller the rigidity k.

Figure 9:
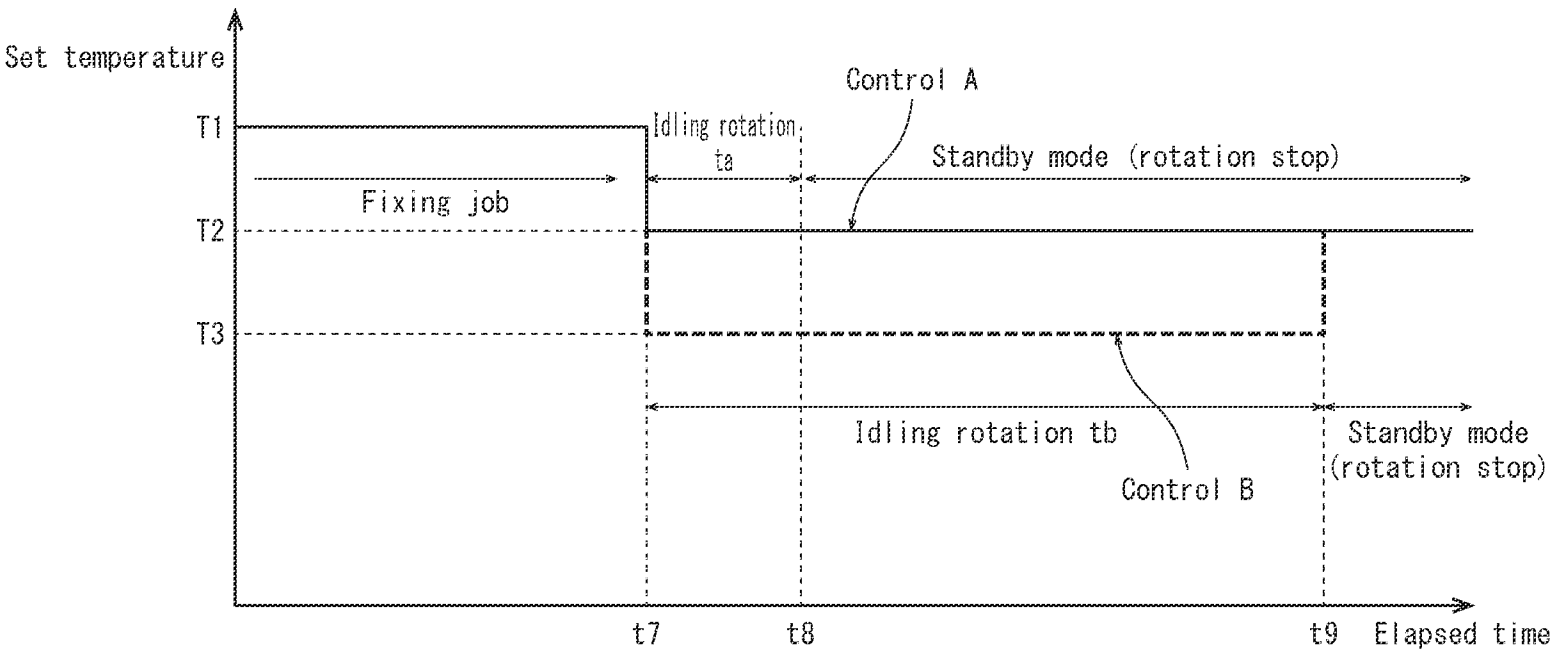
FIG. 9 is a diagram illustrating changes in a target set temperature in a fixing job, subsequent idling rotation, and a standby mode.

In FIG. 9, the solid line is a time chart indicating control (control A) of idling rotation time and target temperature (target set temperature) of the nip Np set by the controller 100 during idling rotation and standby mode after completion of a conventional fixing job, where the horizontal axis indicates elapsed time and the vertical axis indicates target temperature.

As illustrated, conventionally, when a fixing job is executed, a heating control is executed to set a target set temperature T1 (for example, 170° C.) of the heating roller 312 to maintain the nip Np at a temperature required for heat fixing, but in post-processing idling rotation, a heating control is executed to set a target set temperature T2 (for example, 150° C.) that is the same as in the standby mode. At this time, a post-processing idling rotation time to is about 15 seconds.

In this way, even after a fixing job is completed, although temperature is slightly lower than the temperature T1 at the time of fixing, idling is only for a short time at the relatively high temperature Ts (150° C.), and there is almost no decrease in the heat storage index value due to the idling rotation.

Figure 10:
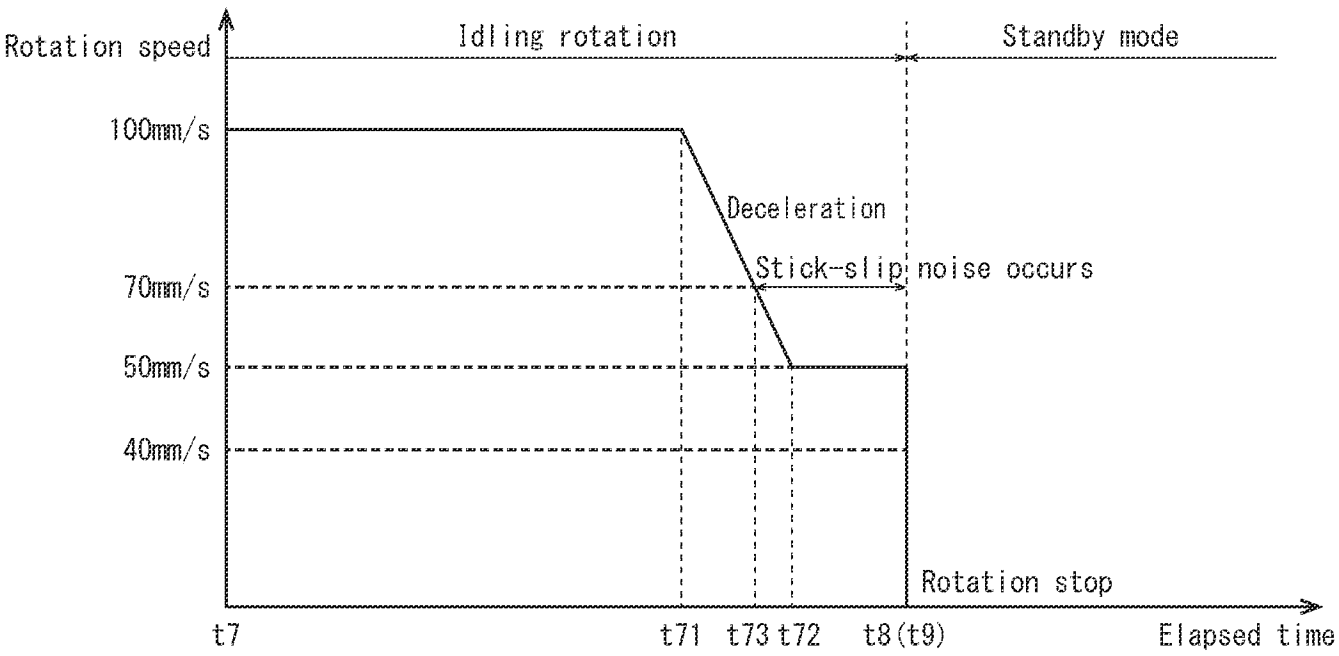
FIG. 10 is a time chart illustrating gradual deceleration when idling rotation is stopped.

FIG. 10 is a time chart illustrating an enlargement of a state of post-processing idling rotation at time t7 in FIG. 6, and a stopping control. The horizontal axis indicates elapsed time, and the vertical axis indicates rotation speed of the fixing belt 311.

According to the present embodiment, units indicating "rotation speed" are not rpm (rotations per minute), but travel speed (sheet feed rate in mm/s)

At time t7, post-processing idling rotation starts. Rotation speed at this time is 100 mm/s in this example, which is sufficiently large that even if a large amount of heat is stored in the nip forming members (i.e., the heat storage index value is high), there is no risk of stick-slip occurrence.

As described above, in order to prevent uneven fixing, a pressure contact force of the pressure roller 32 with respect to the fixing belt 311 is set to be large, and when power supply to the fixing motor M2 is stopped, the pressure roller 32 and the like suddenly stop.

When stopping suddenly from high speed rotation, damage to the pressure roller 32 and the fixing belt 311 is large (in particular, heat will overshoot to a high temperature, and it is easy to cause a lot of heat damage to material of the nip), and therefore speed is gradually reduced. That is, a control is executed such that deceleration is started at time t71, and by time t72, rotation speed is reduced to 50 mm/s, for example, and maintained at 50 mm/s until at time t8, power supply to the fixing motor M2 is stopped, immediately stopping rotation. Even a sudden stop from the relatively low rotation speed of 50 mm/s will not cause much damage to each member.

However, rotation may alternatively be stopped at the time rotation speed decreases to 50 mm/s (time t72).

However, as explained above in connection with Expression (1), the larger the heat storage of the nip forming members (the larger the heat storage index value), and the larger the index value of $\Delta\mu$ (duration index value), the easier it is for stick-slip to occur.

Therefore, when the duration index value is equal to or above a certain level, then depending on magnitude of the heat storage index value, for example as illustrated in FIG. 10, when rotation speed is decelerating, for example at 70 mm/s (time t73), stick-slip noise may start to occur, and continue until the sudden stop at time t8.

Therefore, according to the present embodiment, in order to avoid such inconvenience, at the post-processing start time t7, when the duration index value is equal to or above a certain value and the heat storage index value is equal to or above a defined threshold value, in order to avoid stick-slip noise in deceleration during post-processing idling rotation, the target set temperature in the post-processing idling rotation is lowered and the time from the start of the post-processing idling rotation until deceleration is made longer.

That is, when the fixing job ends at time t7 as indicated by the bolded dashed line in FIG. 9, the set target temperature T3 is set lower than the standby temperature T2, and post-processing idling rotation is extended to time t9.

According to the present embodiment, the idling rotation time of a conventional control is extended from 15 seconds to 60 seconds (1 minute) (control B).

The set temperature during post-processing idling rotation is low and the rotation time is long, and therefore heat dissipation progresses and at the start of deceleration of idling rotation (time t71 in FIG. 10), the heat storage index is lower than that of the conventional control A. Accordingly, by the time the rotation speed is reduced to 50 mm/s, conditions for stick-slip noise have not yet been met, and subsequently, when rotation speed is suddenly stopped at time t9, the fixing belt 311, the pressure roller 32, etc., can be stopped without any opportunity for stick-slip noise generation.

After post-processing idling rotation is stopped (time t9), the set temperature is raised to T2 and the standby mode is transitioned to (see FIG. 9).

(6) Control System

FIG. 11 is a block diagram illustrating structure of an overall control system of the printer 1 according to the present embodiment.

As illustrated, the controller 100 includes a central processing unit (CPU) 101, random access memory (RAM) 102, the ROM 103, the counter 104, and the backup memory 105.

The CPU 101 can communicate with the feeding section 10, the imaging section 20, the fixing section 30, the ejecting section 40, the double-sided conveying section, and the network I/F 110.

The ROM 103 stores in advance a control program for executing print jobs and the like.

When the network I/F 110 receives print job data send from an external terminal device via a network (such as a local area network (LAN)), the CPU 101 reads a required program from the ROM 103, uses the RAM 102 as a work area, coordinates control of operations of the feeding section 10, the imaging section 20, the fixing section 30, the ejecting section, and the double-sided conveying section 50 to smoothly execute a print job based on the received print job data.

The counter 104 counts the belt rotation time Tr and the rotation stop time Ts of the fixing belt 311. The backup memory 105 is a non-volatile memory and backs up the count value of the counter 104, the count of the number of prints, and the like, at the defined timing (first timing) described above. When backing up, the number of prints and the like are cumulatively added, but the belt rotation time Tr, the rotation stop time Ts, the corrected rotation time $T\delta$, and the like are overwritten.

When backed up to the backup memory 105, the counter 104 resets each count value and starts counting for the next fixing job.

Based on the detection result of the temperature sensor 315, the CPU 101 controls power supply to the heater 314 to maintain temperature of the nip Np at the target temperature. Further, the CPU 101 controls rotation speed of the fixing motor M2 when a fixing job is executed.

Further, based on the duration index value and heat storage index value calculated from numerical values stored in the backup memory 105, when stopping post-processing idling rotation, the CPU 101 executes idling rotation control that controls target set temperature and rotation time during post-processing idling rotation in order that stick-slip noise is not generated.

(7) Idling Rotation Control

Figure 12:
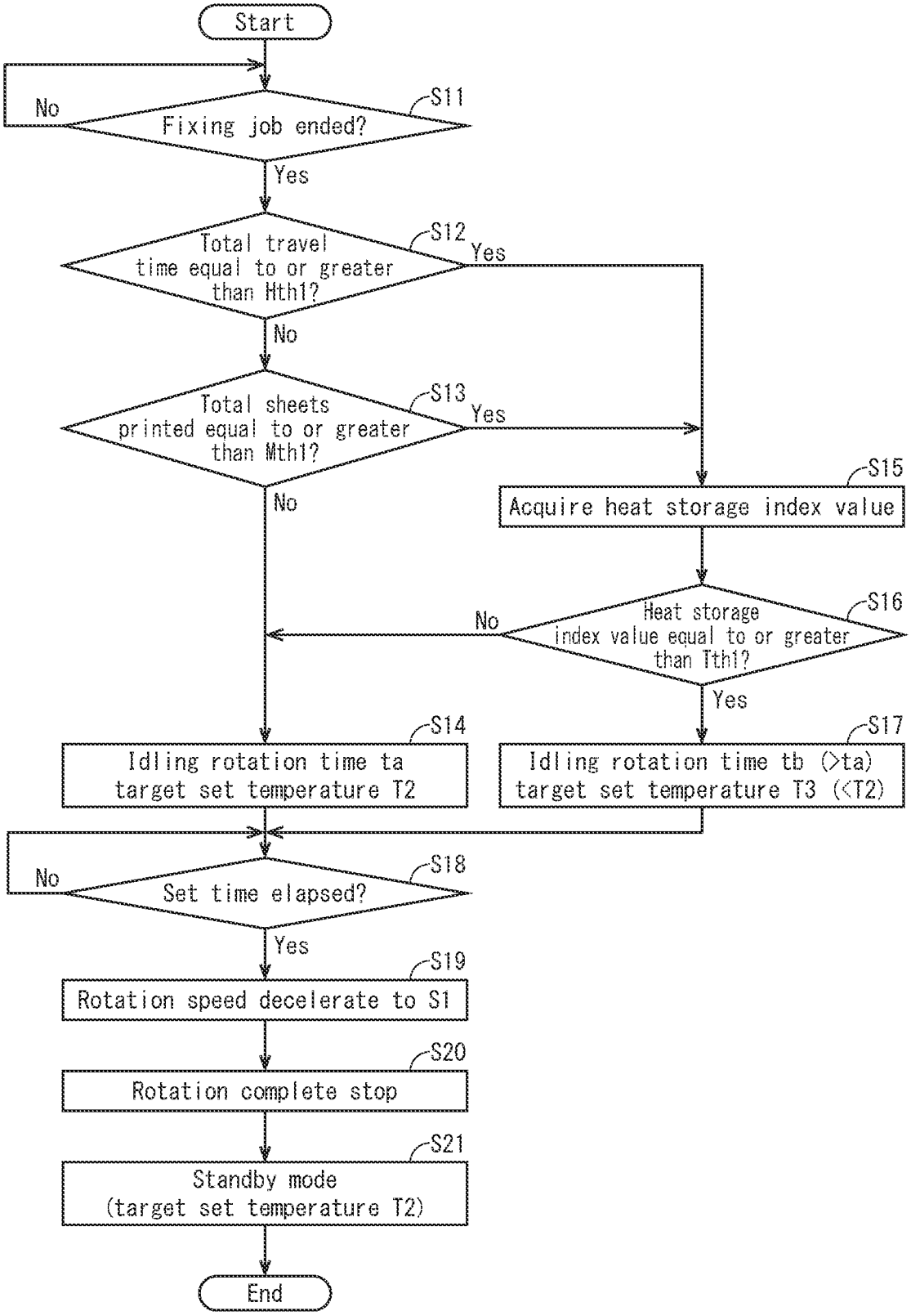
FIG. 12 is a flowchart illustrating an idling rotation stop speed control procedure executed by a controller pertaining to Embodiment 1.

FIG. 12 is a flowchart illustrating idling rotation control operations executed by the controller 100.

First, whether or not a fixing job has been completed is determined (step S11). The CPU 101 acquired job information of the print job from the RAM 102, and determines that the fixing job is completed when printing is completed for the specified number of sheets.

If a fixing job is completed ("Yes" in step S11), then it is determined whether or not total travel distance of the fixing belt 311 is equal to or greater than a defined threshold value Hth1 (step S12). If the total travel distance is less than the threshold value Hth1 ("No" in step S12), then it is determined whether or not the total number of prints is equal to or greater than a threshold value Mth1 (step S13).

As described above, if a duration index value such as the total travel distance or the total number of prints (if only focusing on the fixing jobs, the total number of sheets passed through) becomes large, the value $\Delta\mu$ in Expression (1) becomes larger, and therefore the parameter $\lambda$ indicating the possibility of stick-slip occurrence becomes large. To put it another way, threshold values Hth1 and Mth1 (first threshold value) are determined in advance for each model by experiments and the like, and stored in the ROM 103, such that if the total number of prints is less than the threshold value, then when the travel speed of the fixing belt 311 is relatively slow, even when heat stored in the nip Np is relatively high, there is no risk of stick-slip noise.

According to the present embodiment, Hth1 is set to 500 Km, for example, and Mth1 is set to 500,000 sheets, for example.

According to the present embodiment, the wear rate while paper is being passed through is very significant, and the influence on Δμ is also considered to be large, and therefore in step S12 wear is determined in terms of the total travel distance, then in step S13 wear is determined in terms of the total number of prints, thereby judging the probability of the occurrence of stick-slip noise more accurately. However, according to at least one embodiment, only one of the determinations is used (for example, only that of step S13).

If "No" is determined in both steps S12 and S13, it is determined that there is no risk of stick-slip occurrence even if speed is gradually reduced during idling rotation stopping, and idling rotation duration is set to initial device conditions to to seconds (for example, 15 s), and the target set temperature is set to the target set temperature of the standby mode T2° C. (for example, 150° C.).

Them when a time set in step S14 elapses from the start of idling rotation ("Yes" in step S18), rotation speed is reduced temporarily to Si (50 mm/s in the example of FIG. 10) (step S19), then rotation is stopped (step S20), standby mode is transitioned to (step S21), and temperature of the heating roller 312 is adjusted to maintain the standby temperature T2.

Further, if "Yes" is determined in either step S12 or step S13, it is determined that there is a high possibility that stick-slipping will occur, and therefore in step S15 the heat storage index value of the nip forming members is acquired.

As can be seen from the time chart of FIG. 8, in the case of post-processing idling rotation performed at time t7 after the end of nth fixing job in the narrow sense, the heat storage value is the sum of the corrected rotation time Tδ(n) and the belt rotation time (t7–t5), which is the sum of warm-up time and the fixing job execution time in the narrow sense for the nth fixing job.

In step S16, it is determined whether or not the acquired heat storage index value is equal to or greater than a threshold value Tth1 seconds.

As the threshold value Tth1 (second threshold value), a numerical value is obtained in advance by experiments or the like, and stored in the ROM 103, the numerical value indicating a high probability of stick-slip occurrence when rotation speed of the fixing belt 311 is equal to or greater than 50 mm/s and less than 100 mm/s According to the present embodiment, the threshold value Tth1 is set to 60 seconds.

If the index value is equal to or higher than the threshold value Tth1 seconds ("Yes" in step S16), idling rotation is executed with a heating control such that the idling rotation time is set to tb seconds (for example, 60 s), which is longer than to seconds, and the heating target temperature of the heating roller 312 is set to T3° C. (for example, 140° C.), which is lower than T2° C. (step S17).

Then, when the time set in step S17 elapses from execution of idling rotation ("Yes" in step S18), rotation speed is decelerated to S1 (step S19), and subsequently rotation is stopped (step S20), standby mode is transitioned to (step S21), the heating roller 312 temperature is increased to the standby temperature T2° C. and maintained.

The lower T3° C. is, the less likely stick-slipping is to occur, but a value that enables a quick return to the standby temperature after idling rotation stops is desirable, and according to the present embodiment this is about 10° C. to 20° C. less than the standby temperature.

By continuing idling rotation for a relatively long time at the lower temperature T3° C., the heat storage index value of the nip forming members decreases due to heat dissipation, and therefore rigidity of the nip forming rotating body increases, and even when rotation speed of the fixing belt 311 is reduced to 50 mm/s, generation of stick-slip noise can be suppressed.

In step S16, if the heat storage index value is less than Tth1 seconds ("No" in step S16), it is determined that there is still no risk of stick-slip noise even during deceleration, and processing proceeds to step S14. After rotation for only to seconds at the target set temperature T2° C. ("Yes" in step S18), rotation speed of idling rotation is gradually reduced, rotation is completely stopped, the standby mode is transitioned to (steps S19, S20, S21), and the idling rotation control ends.

Normally, if a subsequent print job is not received even after a defined time has elapsed after shifting to the standby mode, power supply to the heater 314 is stopped or an energy saving mode (sleep mode) is transitioned to in which the target set temperature is set significantly lower than the standby temperature.

A defined time until shifting to the sleep mode is, for example, about 10 minutes to 30 minutes, but according to at least one embodiment, an administrator may change this arbitrarily according to frequency of use of the device.

As above, according to the present embodiment, the probability of stick-slip noise during idling rotation stopping processing is determined by an index value (duration index value) of total travel distance and total number of printed sheets and the heat storage index value of the nip forming members, and only when the probability is high, the target set temperature for idling rotation is lowered and idling rotation time is increased to reduce heat stored, and therefore even if idling rotation speed is gradually reduced to avoid damage to the nip forming rotation body, occurrence of stick-slip noise can be effectively suppressed while doing so.

Embodiment 2

Embodiment 2 according the present disclosure has the same hardware structure as Embodiment 1, and only content of a control of rotation speed of the fixing belt 311 during idling rotation (hereinafter also referred to as "idling rotation speed control") is different, and therefore description of Embodiment 2 is based on only a flowchart of content of the idling rotation speed control.

The present embodiment also indicates rotation speed not in rpm, but in a travel speed of millimeters per second.

Figure 13:
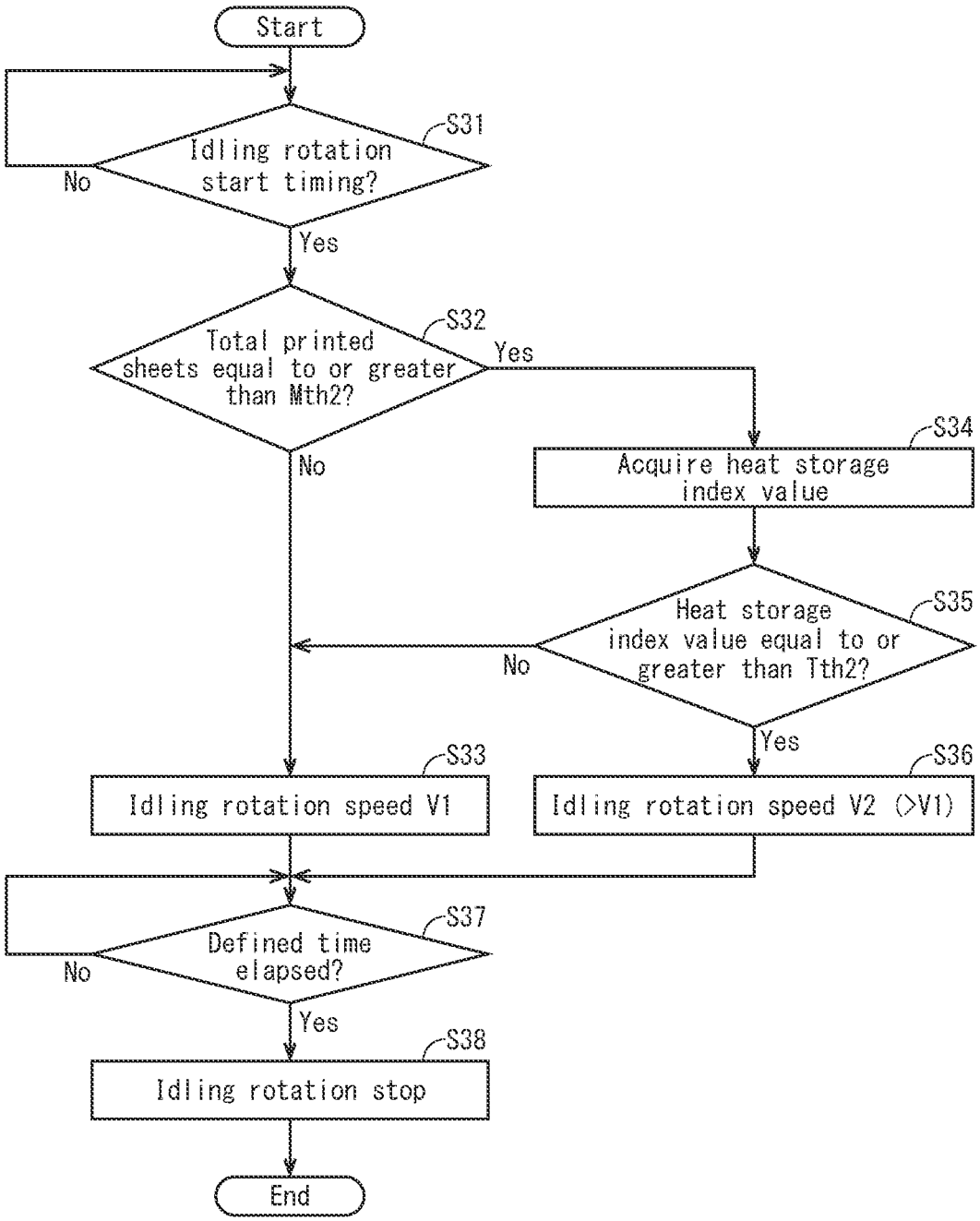
FIG. 13 is a flowchart illustrating an idling rotation stop speed control procedure executed by a controller pertaining to Embodiment 2 of the present disclosure.

FIG. 13 is a flowchart illustrating operations of the idling rotation speed control executed by the controller 100.

First, whether or not it is time for idling rotation to start is determined (step S31). According to the present embodiment, idling rotation is performed when the device is powered on, when a print job is received, during warm-up from standby mode to increase temperature of the fixing belt 311 to a fixing temperature, and immediately after a fixing job to dissipate heat in the nip Np.

When it is time to start idling rotation ("Yes" in step S31), it is determined whether or not the total number of prints stored in the backup memory 105 is equal to or greater than a threshold value Mth2 (step S32).

As described above, as the total number of printed sheets increases, Δμ increases, and therefore the parameter λ indicating the possibility of stick-slipping in Expression (1) increases. To put it another way, the threshold value Mth2 is set such that if the total number of prints is less than the threshold value, then when the travel speed of the fixing belt 311 is relatively slow, even when heat stored in the nip Np is relatively high, there is no risk of stick-slip noise.

According to the present embodiment, the threshold value Mth2 is set to be about 300,000 sheets, but an appropriate value from 200,000 to 300,000 may be determined in advance by experimentation for each model. The value of the threshold value Mth2 is stored in advance in the ROM 103.

If the total number of prints is less than the threshold value Mth2 ("No" in step S32), there is little risk of stick-slip noise occurring as described above, and therefore idling rotation speed (travel speed) is set to V1 and idling rotation is started. According to the present embodiment, V1 (initial setting) is 70 mm/s, for example.

After elapse of a defined time, rotation of the fixing belt 311 is stopped (step S37), and the idling rotation speed control ends.

If the total number of prints is equal to or greater than the threshold value Mth2 in step S32 ("Yes" in step S32), then as described above, $\Delta_N$, becomes large and there is a high possibility of stick-slip noise, and therefore in step S34, the heat storage index value of the nip Np is acquired (step S34).

The heat storage index value varies depending on whether idling rotation is warm-up (pre-processing idling rotation) or post-processing idling rotation.

As illustrated in FIG. 6, for example when the nth fixing job execution starts, warm-up is started at time t5, at which time the index value of heat stored in the nip Np is the corrected rotation time Tδ(n), as illustrated in FIG. 8.

On the other hand, when idling rotation is post-processing idling rotation at time t7 after the end of the fixing job in the narrow sense, the index value is the value left after subtracting the post-processing rotation time (t8−t7) from R(n), where R(n)=Tr(n)+Tδ(n).

That is, the index value is the sum of the corrected rotation time Tδ(n) and the belt rotation time that is the sum of warm-up time and the fixing job execution time in the narrow sense for the nth fixing job.

In step S35, it is determined whether or not the acquired index value is equal to or greater than the threshold value Tth2 seconds.

Here, as the threshold value Tth2, a numerical value is obtained by experiments or the like and stored in the ROM 103, the threshold value Tth2 indicating a high probability of stick-slipping occurrence when rotation speed of the fixing belt 311 is V1. According to the present embodiment, the threshold value Tth2 is set to 300 seconds.

If the index value is Tth2 seconds or more ("Yes" in step S35), idling rotation speed is set to V2 that is larger than V1 and idling rotation is started (step S36), and processing proceeds to step S37.

This speed V2 is a speed at which stick-slip noise is not generated even if the heat storage index value increases within a range of normal use when the total number of printed sheets is exceeds Mth2, and is a value obtained by experiments or the like and stored in the ROM 103. Specifically, according to the present embodiment, V2 is 120 mm/s If the index value is less than Tth2 ("No" in step S35), it is determined that there is no risk of stick-slip noise even if the idling rotation speed is V1, and processing proceeds to step S33.

Then, when the defined time elapses, idling rotation is stopped ("Yes" in step S37, step S38), and the idling rotation speed control ends.

As described above, according to the present embodiment, the heat storage index value is obtained comprehensively in consideration of rotation time of the fixing belt 311 during heating control and rotation stopping time, and therefore heat stored in the nip Np can be more accurately reflected. Further, judgment is made based on two states: the total number of sheets printed (duration index value) and the heat storage index value, and therefore idling rotation speed can be increased to prevent stick-slip noise only when there is a risk of stick-slip noise occurrence.

Compared to conventional systems, when rotation speed is always increased during idling rotation, or when rotation speed is mechanically controlled by the number of jobs per sheet of paper, the requirement to pointlessly increase idling rotation speed is eliminated, and noise due to stick-slipping is avoided while also suppressing shortening of life of the fixing section 30.

According to the idling rotation speed control of the present embodiment, the total number of sheets printed is adopted as the index value of Δμ in Expression (1), but instead of the total number of printed sheets, the total travel distance of the fixing belt 311 (heating rotating body) may be the index value of Δμ. Of course, in this case another threshold value is set. The fixing belt 311 rotates not only when a sheet is being fixed, and therefore total travel distance is more likely to reflect the amount of change in Δμ.

Further, as in Embodiment 1, the probability of stick-slip occurrence may be determined by comparing each of the total number of prints and the total travel distance to respective threshold values.

<Modifications>

Although the present invention has been described based on embodiments, the present disclosure is of course not limited to the embodiments described above, and the following modifications are possible.

(1) According to at least one embodiment, of conditions of stick-slip occurrence indicated in Expression (1), index values are obtained for each of the two parameters Δμ (difference between static friction coefficient and dynamic friction coefficient) and rigidity k of elastic material in the nip forming members, and these index values are compared with threshold values to determine the probability of stick-slip noise occurring, but in addition to these index values, it may be considered that the probability of stick-slip noise occurring can be determined more accurately by adding an index value indicating W (load) in Expression (1) as a parameter.

As described above, normally, the heating rotating body and the pressure rotating body are pressed against each other by an elastic material such as a spring with a constant pressure contact force (corresponding to the load W), but as the nip forming members is heated, it expands against the force of the spring, and therefore the displacement amount of the spring increases and the load increases.

As can be seen from Expression (1), as the load (W) increases, the value of the parameter λ also increases, and therefore the probability of stick-slip noise also increases.

When the load at the nip Np increases, it becomes necessary to drive the rotating body (according to at least one embodiment, the pressure roller 32) with a large driving torque in order to maintain a target rotation speed. Accordingly, the magnitude of the load W can be estimated by detecting variance in drive torque.

In order to detect drive torque variance, a torque sensor may be provided on the drive shaft or the like of the fixing motor M2 (see FIG. 1, FIG. 11), but according to the present modification, when the pressure roller 32 is driven at a defined rotation speed, a change in drive current is acquired by a drive current detector (not illustrated) that detects current supplied to the fixing motor M2, and based on this value a change in drive torque is acquired.

Rotation speed of the fixing motor M2 can be acquired by, for example, the number of output pulses per unit time from an optical encoder built into the motor M2. The controller 100, with reference to the output pulses, controls current supplied so that the fixing motor M2 has a constant rotation speed.

As drive torque increases, the amount of current supplied to the fixing motor M2 to maintain a constant rotation speed also increases, and therefore if a change is detected, the amount of change of drive torque, and therefore magnitude of load can be estimated.

Therefore, according to the present modification, change in drive current of the fixing motor M2 during constant speed rotation control is used as an index value for the magnitude of the load (hereinafter also referred to as "third index value" or "load index value").

According to the present modification, it is assumed that drive current during constant speed rotation control when executing a fixing job immediately preceding idling rotation is acquired as the load index value.

Figure 14:
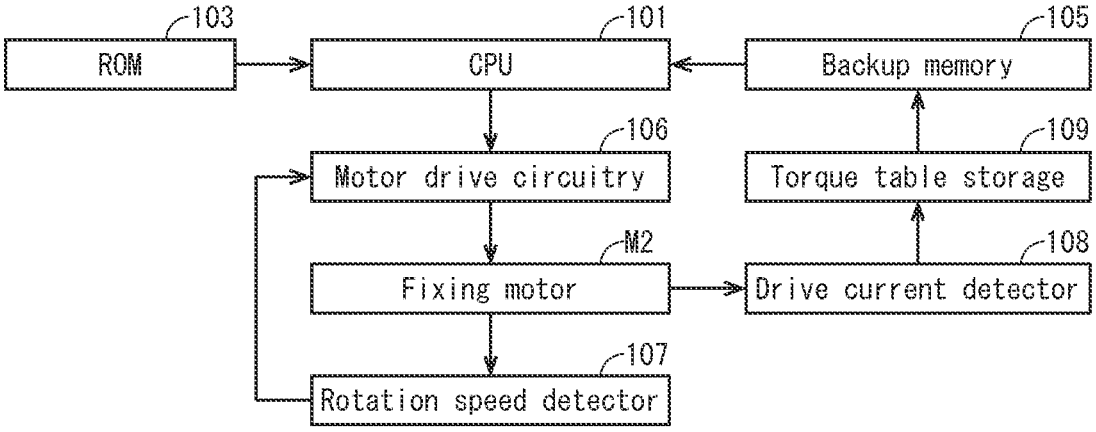
FIG. 14 is a block diagram illustrating circuitry for detecting drive torque of a fixing motor via changes in drive current according to a modification.

FIG. 14 is a block diagram in which only a portion related to detection of drive torque is extracted from controller 100 to implement the present modification.

For example, when executing a fixing job, the CPU 101 acquires a value of rotation speed of the fixing motor M2 to achieve constant rotation speed (system speed) from the ROM 103, and instructs motor drive circuitry 106 accordingly. The motor drive circuit 106 supplies a defined current to rotate the fixing motor M2 at the rotation speed.

Rotation speed of the fixing motor M2 is detected by a rotation speed detector 107 (optical encoder) and input to the motor drive circuitry 106. As a result, rotation speed of the fixing motor M2 is feedback controlled to a target rotation speed.

The drive current detector 108 detects a current value supplied from the motor drive circuitry 106 to the fixing motor M2. A torque table storage 109 is a non-volatile memory in which a table is stored showing a relationship obtained in advance between magnitude of a drive current value and drive torque of the pressure roller 32. The CPU 101 references the table, samples torque drive values during fixing jobs, and backs up sampled values at fixing job completion or averaged values during fixing jobs to a defined memory area in the backup memory 105.

When this modification is applied to the idling rotation control of Embodiment 1, for example, a load index value determination step (load determination step) is inserted between steps S16 and S17 in the flowchart of FIG. 12.

In this load determination step, a drive torque value at the time of executing the immediately preceding fixing job is read from the backup memory 105, and if the drive torque value is equal to or greater than a defined threshold value (third threshold value, for example 0.8 Nm), it is determined that the probability of stick-slip noise generation is increased, processing proceeds to step S17, idling rotation time is set to tb, target set temperature is set to T3, and idling rotation starts.

If the drive torque is less than the defined threshold value, processing proceeds to step S14 to set the idling rotation time to to and the target set temperature to T2.

Further, when this modification is applied to the idling rotation speed control of Embodiment 2, a load determination step is inserted between steps S35 and S36 in the flowchart of FIG. 13.

If drive torque is determined to be equal to or higher than a defined threshold value in this load determination step, it is determined that the probability of stick-slip noise generation has increased, and processing can proceed to step S36 and idling rotation speed is set to V2.

If the drive torque is less than the defined threshold value, processing proceeds to step S33 to set the idling rotation time to V1, which is an initial setting.

According to this modification, a load index value indicating W (load) is used in addition to the two duration index value parameters $\Delta\mu$ (difference between static friction coefficient and dynamic friction coefficient) and k (rigidity of nip forming members) and the heat storage index value in determining the probability of stick-slip noise, and idling rotation time and target set temperature are controlled, but a configuration is also possible in which the load index value is used instead of one or the other of the duration index value and the heat storage index value.

That is, idling rotation time and target set temperature may be controlled by a two-step determination based on a load index value and a heat storage index value or a two-step determination based on a duration index value and a load index value.

(2) According to modification (1) above, variations in drive current are obtained as a load index value of drive torque of a pressure rotating body (pressure roller) as a parameter of load W in Expression (1), but it is also possible to measure a displacement amount of the tension spring (or compression spring) that pushes the pressure rotating body against the heating rotated body, and a force of the spring can be acquired from the displacement amount and spring coefficient.

Figure 15:
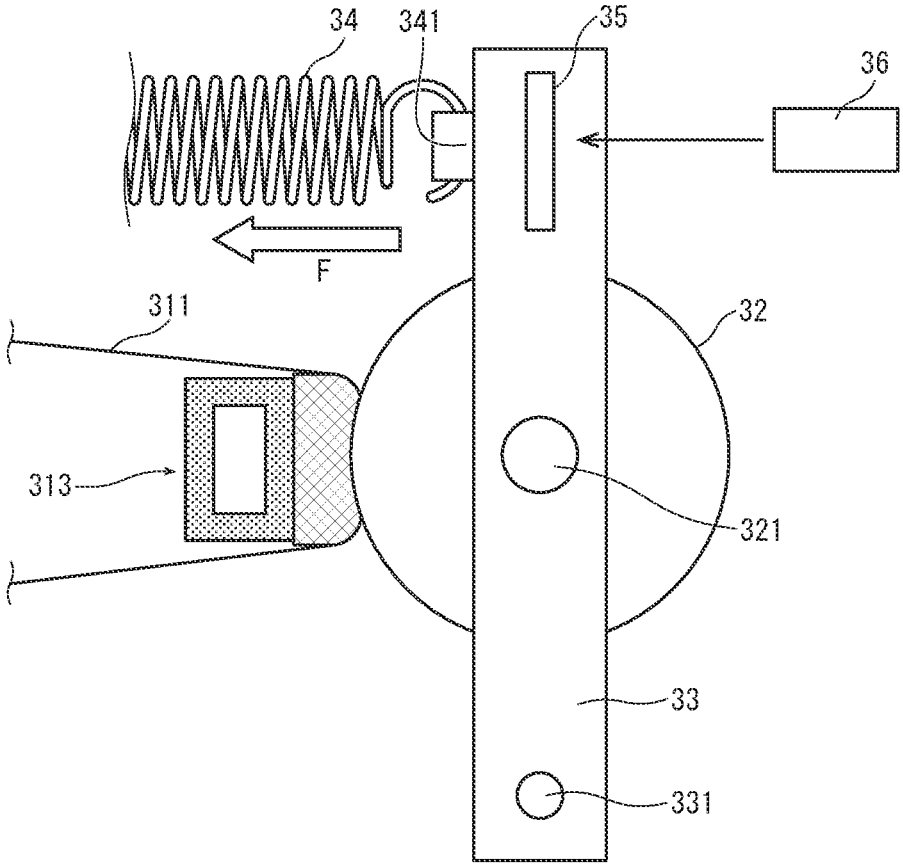
FIG. 15 is a diagram illustrating structure for detecting a load (pressure contact force) of a pressure roller on a fixing belt according to a modification.

FIG. 15 is a schematic diagram illustrating an example of structure of the fixing section 30 in such a case.

A shaft 321 of the pressure roller 32 is rotatably supported by a pair of swing arms 33 at both ends of the shaft 321 in the axial direction thereof (only the swing arm at the front side is visible in the diagram), and lower ends of the swing arms 33 are rotatably supported by a frame (not shown) of the fixing section 30 via a support shaft 331.

A force in the direction of the arrow F is applied to upper ends of the swing arms 33 by the tension spring 34. A detection plate 35 stands out from an upper end of one of the swing arms 33, and by detecting a position of the detection plate 35 via sampling by a displacement detector 36, an amount of change in position of the detection plate 35 can be known, and therefore a change in elongation of the tension spring 34 due to expansion or contraction of the pressure rotating body can be acquired, and the force applied by the tension spring 34 can be obtained by calculation.

In this case, if the force applied by the tension spring 34 is obtained, a relative pressure contact force of the pressure roller 32 on the fixing belt 311 can be obtained from a ratio of a distance from the shaft 331 to the shaft 321 to a distance from the shaft 331 to a locking position 341 of the tension spring 34, and therefore this can be used as a load index value.

According to the present modification, a correspondence table for load W at the nip Np and displacement amount of the detection plate 35 is obtained in advance and stored in the ROM 103 or the like. By referring to this table, the load W can be acquired based on changes in elongation of the tension spring 34.

In this way, a threshold value (third threshold value) when a load (pressure contact force) of the pressure roller 32 is applied directly to the fixing belt 311 can be set to, for example, 100 N.

If an acquired load is greater than 100 N, it is determined that the probability of stick-slip noise is sufficiently high, the target set temperature during idling rotation is lowered, and rotation time is lengthened.

As the displacement detector 36, an optical displacement sensor, a magnetic displacement sensor, an ultrasound displacement sensor, a differential transformer displacement sensor, or the like can be used as appropriate.

(3) Relationship Between Drive Torque and $\Delta\mu$

According to modification (2) above, as a parameter of the load W in Expression (1), drive torque of a pressure rotating body (pressure roller) is obtained from a change in drive current and used as a load index value, but a change in drive torque can also be used as an index value of change in $\Delta\mu$.

That is, it is known that when a coating on the surface layer of the heating rotating body (fixing belt 311) is worn off due to deterioration over time and the friction coefficient $\mu$ increases, drive torque of the pressure rotating body (pressure roller 32) also tends to increase. In particular, drive torque at the moment when drive is started becomes large, and therefore it is understood that the static friction coefficient becomes larger than the dynamic friction coefficient due to deterioration over time. As a result, the inventors found that as $A_N$, becomes large, stick-slip noise is more likely to occur.

Accordingly, change in drive torque can be an index of change in $\Delta\mu$. Specifically, as a method of determining probability of stick-slip occurrence from drive torque, for example, a change in $\Delta\mu$ can be estimated by obtaining a difference in drive torque at the start of driving (affected by static friction force) and drive torque during subsequent rotation (affected by dynamic friction force), and this change can be compared with a predefined threshold value.

Of course, as described above, a change in the load W also appears as a change in drive torque, and therefore drive torque can be used as an index for both the load W and $A_N$, parameters.

(4) Influence of Radiant Heat on Heating Roller

According to the fixing section 30 of at least one embodiment, a heat source (heater 314) and the nip Np are separated from each other and the nip Np is heated via the fixing belt 311, and since rotation time of the fixing belt 311 during heating control has a large influence on heat of the nip forming members, the heat storage index value of the nip forming members can be obtained based on a history of belt rotation time.

However, even if the fixing belt 311 is not rotating, the fixing section 30 as a whole is warmed by radiant heat from the heating roller 312, heat conduction through air, and convection (hereinafter also referred to as "radiant heat and the like"), and therefore heat is also stored in the fixing member 313, the fixing belt 311, the pressure roller 32, and the like. Accordingly, by taking into consideration warming due to radiant heat and the like, a more accurate index value can be expected.

When a time in which the heating roller 312 ("heater") is controlled to reach a relatively high temperature is defined as "heating control time", such as during a warm-up control, during fixing job execution in the broad sense that includes idling rotation, and during idling mode, then during the heating control time, an amount of heat from radiant heat and the like from the heating roller 312 is also applied to the nip forming rotating body, and therefore by summing a history of this heating control time a total heating control time can be obtained, and a parameter indicating warming from radiant heat and the like can be acquired (second parameter).

The heating control time is counted by the counter 104 (see FIG. 11) from each start of heating control and is, for example, backed up to the backup memory 105 at a timing (second timing) such as at any one of the end of warming up, the end of a fixing job, or the end of power supply to the heater, and at a timing such as when stopping post-processing idling rotation or at an end of standby mode.

This "heating control time" does not necessarily have to represent measuring all heating times of the heating roller 312, and it may be considered that a set temperature during fixing job execution in the narrow sense is highest, and has the greatest influence on heat stored in the nip forming members, and therefore heating control time may at minimum represent selectively measuring only fixing job execution time.

However, the heating roller 312 is not always subject to a heating control and normally, when a defined time elapses after shifting to the standby mode, the heating roller 312 executes a sleep mode for power saving.

When the sleep mode is executed, either heating control is completely stopped (no heating is performed at all) or temperature is maintained at a very low temperature even if heated, and therefore warming due to radiant heat or the like gradually decreases and therefore it is preferable that a time obtained by adding a correction to the total heating control time at a start of the sleeping mode (hereinafter also referred to a "corrected control time") is added to subsequent heating control time to obtain a current total heating control time as an index of warming (heat storage) due to radiant heat and the like.

When Ct(n) represents heating control time while an nth fixing job in the broad sense is executed, and $C\delta(n)$ represents a corrected control time obtained by a correction to a total heating control time of fixing job execution prior to the immediately preceding fixing job corrected according to time elapsed in sleep mode, and S(n) represents a total heating control time, which is an index of warming of the fixing section 30 as a whole at the end of the heating control executed for the nth fixing job, then as per the belt rotation time described above, it is possible to express total heating control time as $S(n)=Ct(n)+C\delta(n)$.

Here, $C\delta(n)$ is the total heating control time P(n−1) backed up at the end of the previous standby mode corrected in consideration of heat dissipation due to subsequent elapsed time (including sleep mode time), and according to the present modification, correction is made based on temperature of the heating roller 312 detected by the temperature sensor 315 at the start of warm-up after backup.

This is because a decrease in temperature of the heating roller 312 is considered to reflect heat released from the time of the previous backup.

As illustrated in FIG. 2, strictly speaking, the temperature sensor 315 detects surface temperature of the fixing belt 311, but at the detection position of the temperature sensor 315, the fixing belt 311 and the heating roller 312 are in close contact with each other and thickness of the fixing belt 311 is small, and therefore a temperature detected by the temperature sensor 315 can be regarded as the temperature of the heating roller 312.

FIG. 16 is a table showing correction values Cδ(n) correcting total heating control time S(n−1) backed up at the end of standby mode after the previous fixing job based on surface temperature of the heating roller 312 at a start of a subsequent warm-up (WU). Note that some entries are omitted from the table for simplicity.

For example, when temperature of the heating roller 312 at the start of warm-up is 30° C. or less, temperature of the heating roller 312 drops to almost room temperature and therefore heat stored from a previous heating control is considered to be almost completely dissipated and the corrected control time Cδ(n) is 0 regardless of the value of the backed up S(n−1).

As surface temperature of the heating roller 312 at the start of warm-up gradually rises from 30° C. (that is, as elapsed time from transition to the previous sleep mode to the start of warm-up decreases), the amount of heat dissipated also decreases, and the value of the corrected control time Cδ increases as magnitude of the previously backed up total heating control time S(n−1) increases.

Figure 17:
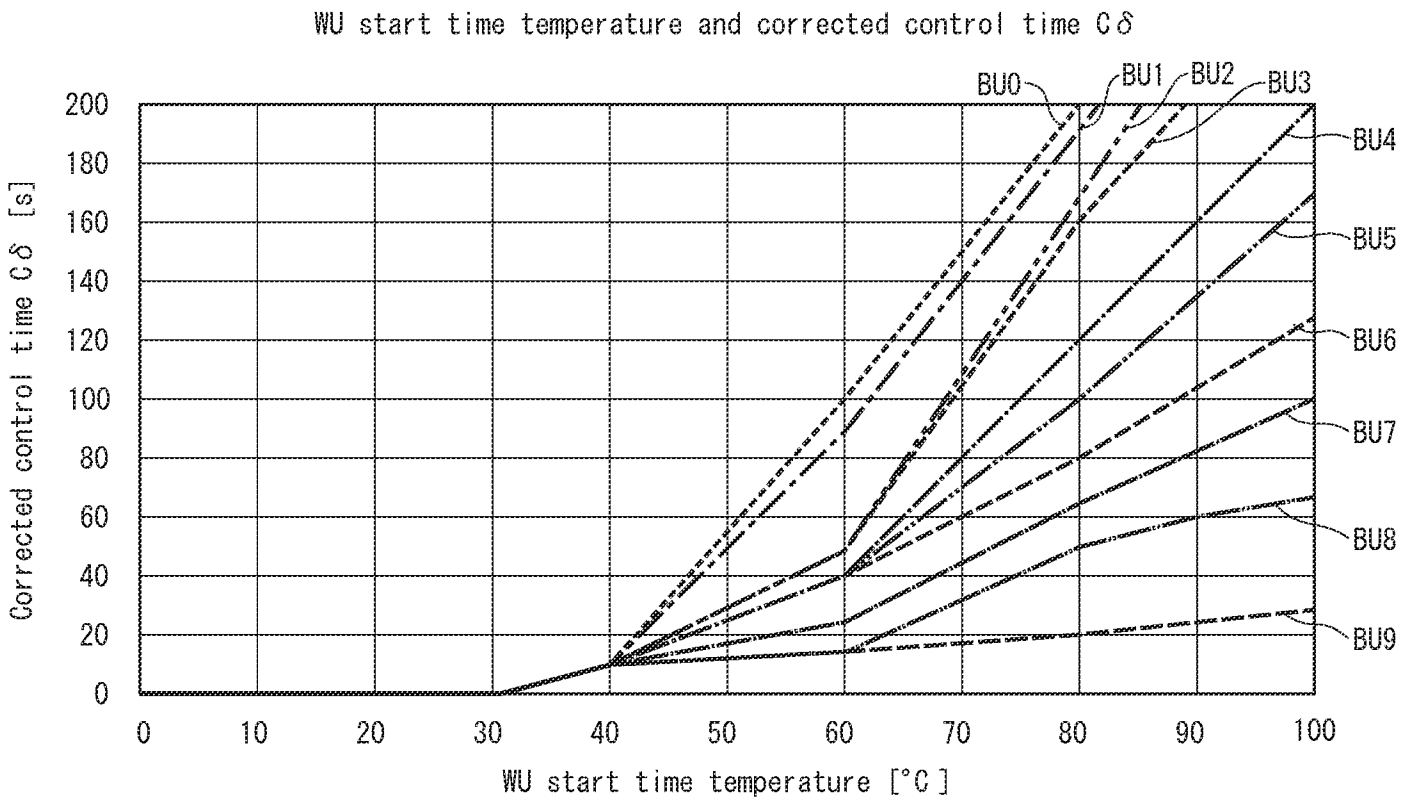
FIG. 17 is a graph illustrating results when a degree of warming of a fixing section according to a modification is corrected by temperature of a heating roller at the start of warm-up.

FIG. 17 is the table of FIG. 16 plotted as a graph. In the graph, the horizontal axis indicates surface temperature in degrees Celsius of the heating roller 312 at the start of warm-up, and the vertical axis indicates values of the corrected control time Cδ(n).

Lines BUO to BU9 indicate the total heating control times S(n−1) 1000 s, 800 s, 600 s, 480 s, 300 s, 210 s, 150 s, 90 s, 30 s, and 0 s, respectively, converted to the corrected control times Cδ(n).

Accordingly, the corrected control time Cδ can be obtained based on the total heating control time S(n−1) backed up in the backup memory 105 at the start of the previous sleep mode and the temperature of the heating roller 312 at the start of warm up of the nth fixing job, as long as the table of FIG. 16 (second table) or an approximate expression (second arithmetic expression, based on the graph of FIG. 17) is stored in the ROM 103, for example.

Further, the heating control time Ct(n) at the start of warm-up is the heating control time performed in connection with the nth fixing job, and the time backed up in connection with the nth fixing job. Thus, the total heating control time S(n)=Ct(n)+Cδ(n) can be obtained as an index indicating warming of the nip forming rotating body due to radiant heat and the like from the heating roller 312.

As described above, according to the present modification, the heat storage index value of the nip forming members is obtained by adding a parameter (second parameter) indicating total heating control time S(n) of the heating roller 312 (heat source) to a parameter (first parameter) indicating total rotation time R(n) of the fixing belt 311. As a result, a more accurate heat storage index value can be obtained, particularly when the heating roller 312 is used as the heat source and the heating position of the heating roller 312 and the nip Np are separated, as illustrated in FIG. 2.

In normal control, where the fixing belt 311 does not rotate when heating control of the heater 314 is not executed, the heating control time is greater than the belt rotation time, and therefore inconsistency may occur in calculation of heating control time and belt rotation time, and therefore adjustment may be made as follows.

(i) For example, if the device is cooled to some extent when starting to count heating control time (at this time, for example, the temperature detected by temperature sensor 315 is referenced), history of the belt rotation time may be reset. That is, the corrected rotation time Tδ may be set to 0.

This is because if device temperature is low, residual heat stored in the nip Np becomes sufficiently small, and it becomes unnecessary to consider the history of past rotation time.

(ii) Further, for example when heating control is started by intermittent turning off and on of power supply while the device is not sufficiently cooled, substantial heating control time (while power is on) may be less than belt rotation time, and therefore the value of the corrected control time Cδ may be substituted for corrected rotation time Tδ to avoid inconsistency.

Adjustments for avoiding inconsistency between the first parameter and the second parameter as described in (i) and (ii) above are particularly effective when performed at the start of warm-up control.

That is, when temperature detected by the temperature sensor 315 is less than 50° C. at the start of warm-up control, the corrected belt rotation time Tδ indicating a history of belt rotation time is set to "0", and subsequent belt rotation time is set as the first parameter.

Further, if the corrected control time Cδ is smaller than the corrected rotation time Tδ, the corrected control time Cδ is used instead of the corrected rotation time Tδ to obtain the first parameter.

Strictly speaking, the total heating control time is only an indicator of warming of the nip forming members due to radiant heat and the like, and therefore compared to direct heating of the nip Np via rotation of the fixing belt 311, the degree of contribution to an increase in heat stored in the nip Np is different.

Thus, by converting the amount of heat stored in the nip forming members due to radiant heat and the like into belt rotation time and adding to the index value R(n) obtained as described with reference to an embodiment above, an index value that more accurately reflects heat currently stored in the nip Np can be obtained.

To convert an index value of heat stored in the nip Np due to radiant heat or the like (total heat control time) into an index value of heat stored due to belt rotation time as per an embodiment above, for example, an amount of heat stored in the nip forming rotating body per unit time due to radiant heat and the like during a heating control to a target temperature and an amount of heat stored in the nip forming rotating body per unit time due to belt rotation can be obtained by experiments or simulation, a ratio of heat stored per unit time by both routes can be obtained, and the ratio may be multiplied by total heating control time to convert into an index value based on total rotation time.

(5) According to at least one embodiment, the total rotation time R(n) (first parameter) is used as a heat storage index value of the nip forming members, and according to modification (3), the total heat control time S(n) (second parameter) is used in addition to the total rotation time R (first parameter) of the fixing belt 311 as a heat storage index value of the nip forming members, but, for example, in a case where instead of the fixing belt 311 a fixing roller is used, a heat source is disposed in the fixing roller, and the nip Np is formed between the fixing roller and the pressure roller, then it is possible to use only the second parameter indicating total heat control time without the first parameter indicating total rotation time as a heat storage index value.

(6) According to at least one embodiment, when idling rotation is stopped, rotation speed of the pressure roller 32 is first reduced to 50 mm/s, then the pressure roller 32 is completely stopped, but as long as gradual deceleration is used, it may be the case that a complete stop occurs after deceleration to 70 mm/s, or 40 mm/s, for example.

In this case, at the stage of rotation speed immediately before the complete step (for example, 40 mm/s), the target heating temperature is lowered and/or rotation time increased in idling rotation, such that heat stored in the nip Np is sufficiently lowered that stick-slip noise does not occur.

At the time of the final rotation stop, even if power supply to the fixing motor M2 is stopped, it is possible that rotation of the pressure roller 32 or the like may not be stopped immediately due to inertia of the pressure roller 32 or the like. In this case, if rotation gradually slows to a stop, then even if heat stored in the nip forming members is decreased as described above, there is a risk of stick-slip noise being generated for a moment, and therefore a more immediate final rotation stop is preferable. For this reason, a separate braking means may be provided.

The means for braking are not particularly limited, and examples include a brake rotor fixed to a rotation shaft of the pressure roller 32, and a pair of brake pads sandwiching the brake rotor and pushed against it by an appropriate actuator such as a solenoid to forcibly stop rotation of the pressure roller 32 (disc brake), or a power supply control that generates reverse rotation for a moment when the fixing motor M2 stops rotation.

(7) According to at least one embodiment, the image forming device is applied to a tandem type color printer, but as long as the image forming device is an electrophotographic type that has a fixing device that thermally fixes using a nip, the image forming device may be a copying machine, a facsimile machine, a multi-function peripheral (MFP), a monochrome printer, or the like.

(8) Further, the fixing device is not limited to that described above, and a fixing roller may be used instead of the resin pad 3131 that backs up the fixing belt 311 in order to form the nip Np (see FIG. 2).

Further, the heating rotating body is not limited to a fixing belt and may be a roller shape (fixing roller) for example. In this case, the fixing roller and the pressure roller can be regarded as the nip forming members. Similar to a belt-shape structure, disposing a heat source such as a heater towards one side of a roller-shape heating rotating body heats a region distant from the nip Np in the rotation direction, and therefore the idling stop controls described above can be effectively applied.

Further, according to at least one embodiment, a pressure roller (pressure rotating body) is pressed against a fixing belt (heating rotating body) as a pressure member to form the nip Np, but a pressure member such as a pad may be in pressure contact to form the nip Np.

(9) The size, shape, material, number, etc., of each member described above are examples, and appropriate sizes, shapes, materials, numbers, etc., are determined in advance according to device configuration. Further, the present disclosure is not strictly limited to use of Expression (2), and another complex approximate expression can be used, as long as it is an expression that can obtain an index value that indicates heat stored in the nip Np.

Further, numerical values for threshold values for each index value described above are only examples, and appropriate numerical values can be obtained in advance by experiments or the like according to device model or specifications, and stored in the ROM 103 or the like.

With ranges that allow the effects of the present disclosure to be achieved, alternative mechanisms and members having different shapes may be used in place of mechanisms and members described for the fixing section and the like.

<<Supplement>>

Although embodiments of the present invention have been described and illustrated in detail, the disclosed embodiments are made for purposes of illustration and example only and not limitation. The scope of the present invention should be interpreted by terms of the appended claims. In particular, not only one or the other of the idling stop control (first control) of Embodiment 1 and the idling speed control (second control) of Embodiment 2, but according to at least one embodiment both controls may be combined and executed.

What is claimed is:

1. A fixing device that executes a fixing job by passing a sheet on which an unfixed toner image is formed through a nip, the fixing device comprising:

a heating rotating body heated by a heater;

a pressure member pressed against the heating rotating body to form the nip;

a first acquisition unit that acquires a first index value indicating a change in coefficient of friction between the heating rotating body and the pressure member;

a second acquisition unit that acquires a second index value indicating a change in rigidity of an elastic layer in the heating rotating body and/or the pressure member; and a controller that executes at least one of two controls according to the first index value and the second index value: a first control during idling rotation after fixing job execution, for controlling temperature of the heating rotating body and time from a start of the idling rotation to an end of the idling rotation and a second control during idling rotation before and/or after fixing job execution, for controlling rotation speed of the heating rotating body.

2. The fixing device of claim 1, wherein the first index value indicates at least one of a total travel distance of the heating rotating body and a total number of sheets passed through the nip, the second index value includes a first parameter indicating warming of nip forming members that include the heating rotating body and the pressure member, and the controller, when executing the first control, when the first index value is equal to or higher than a first threshold value and the second index value is equal to or higher than a second threshold value, lowers temperature of the heating rotating body and increases time from the start to the end of the idling rotation, relative to initial settings for idling rotation.

3. The fixing device of claim 1, wherein the first index value is at least one of a total travel distance of the heating rotating body and a total number of sheets passed through the nip, the second index value includes a first parameter indicating warming of nip forming members that include the heating rotating body and the pressure member, and the controller, when executing the second control, when the first index value is equal to or higher than a third threshold value and the second index value is equal to or higher than a fourth threshold value, increases rotation speed of the heating rotating body relative to initial settings for idling rotation.

4. The fixing device of claim 2, wherein the second acquisition unit acquires the first parameter according to a history of rotation time of the heating rotating body rotating prior to execution of the idling rotation and stationary time of the heating rotating body not rotating.

5. The fixing device of claim 4, wherein the second acquisition unit comprises:

a rotation time storage that measures rotation time of the heating rotating body at least while executing a fixing job and stores measured rotation time at a first timing as the history of rotation time; and a rotation time correction unit that, when stationary time of the heating rotating body occurs before the start of the idling rotation, corrects a sum of the history of rotation time immediately preceding the stationary time according to length of the stationary time to obtain a corrected rotation time, wherein a total rotation time obtained by adding the corrected rotation time to a history of subsequent rotation time is acquired as the first parameter.

6. The fixing device of claim 5, wherein the first timing includes any one of an end of a fixing job, an end of power supply to the fixing device, and a time of stopping rotation of the heating rotating body.

7. The fixing device of claim 5, wherein the rotation time correction unit corrects the sum of the history of rotation time immediately preceding the stationary time according to length of the stationary time based on a first table or a first arithmetic expression obtained in advance of the correction.

8. The fixing device of claim 5, wherein the second acquisition unit:

in addition to the first parameter, acquires a second parameter according to a heating control time of a heating control executed by the heater immediately preceding the idling rotation; and acquires the second index value according to the first parameter and the second parameter.

9. The fixing device of claim 8, wherein the second acquisition unit further comprises:

a control time storage that measures a heating control time of a heating control executed by the heater at least while executing a fixing job and stores measured heating control time at a second timing as a history of heating control time; and a control time correction unit that corrects a sum of the history of heating control time immediately preceding a warm-up, according to temperature of the heater at a start of the warm-up immediately after the second timing, to obtain a corrected control time, wherein a total heating control time obtained by adding the corrected control time to subsequent heating control time is acquired as the second parameter.

10. The fixing device of claim 9, wherein the second acquisition unit detects temperature of the heater at a start of heating control of the heater, and if detected temperature is equal to or less than a defined threshold, resets the history of the corrected rotation time to acquire the first parameter.

11. The fixing device of claim 9, wherein when the corrected control time is less than the corrected rotation time at the start of heating control of the heater, the second acquisition unit uses the corrected control time instead of the corrected rotation time to acquire the first parameter.

12. The fixing device of claim 10, wherein the start of heating control of the heater is a start of a warm-up control.

13. The fixing device of claim 9, wherein the second timing includes any one of a start of a fixing job, an end of a fixing job, and an end of power supply to the heater.

14. The fixing device of claim 9, wherein the control time correction unit uses a second table or a second arithmetic expression obtained in advance of the correction to correct the sum of the history of heating control time immediately preceding the warm-up, according to temperature of the heater at a start of the warm-up.

15. The fixing device of claim 4, wherein the second acquisition unit:

instead of the first parameter, acquires a second parameter according to a heating control time of a heating control executed by the heater immediately preceding the idling rotation; and uses a value of the second parameter as the second index value.

16. The fixing device of claim 1, further comprising a third acquisition unit that acquires a third index value indicating a relative pressure contact force between the heating rotating body and the pressure member, wherein the controller executes at least one of the two controls according to the first index value, the second index value, and the third index value.

17. The fixing device of claim 1, further comprising a third acquisition unit instead of the first acquisition unit or the second acquisition unit, the third acquisition unit acquiring a third index value that indicates a relative pressure contact force between the heating rotating body and the pressure member, wherein the controller executes at least one of the two controls according to the first index value and the third index value, or the second index value and the third index value.

18. The fixing device of claim 16, wherein the pressure member is a pressure rotating body, one of the pressure rotating body and the heating rotating body is a first rotating body rotationally driven by a drive source, and the other is a second rotating body driven by rotation of the first rotating body, the fixing device further comprises a torque detector that detects drive torque of the first rotating body, wherein the third index value is detected drive torque.

19. The fixing device of claim 1, wherein the controller, when stopping idling rotation of the heating rotating body, causes gradual stepped deceleration of the heating rotating body.

20. The fixing device of claim 1, wherein a heating position where the heater heats the heating rotating body is different from a position of the nip of the heating rotating body.

21. The fixing device of claim 1, wherein the heating rotating body is an endless belt that travels in a circumferential direction thereof, and the heater heats a region of the endless belt that is separated from the nip in the circumferential direction.

22. An image forming device comprising:

an imaging section that forms an unfixed toner image on a sheet; and a fixing section that fixes the unfixed toner image on the sheet, wherein the fixing section includes a fixing device that fixes the unfixed toner image on the sheet by passing the sheet through a nip, the fixing device comprising:

a heating rotating body heated by a heater;

a pressure member pressed against the heating rotating body to form the nip;

a first acquisition unit that acquires a first index value indicating a change in coefficient of friction between the heating rotating body and the pressure member;

a second acquisition unit that acquires a second index value indicating a change in rigidity of an elastic layer in the heating rotating body and/or the pressure member; and a controller that executes at least one of two controls according to the first index value and the second index value: a first control during idling rotation after fixing job execution, for controlling temperature of the heating rotating body and time from a start of the idling rotation to an end of the idling rotation and a second control during idling rotation before and/or after fixing job execution, for controlling rotation speed of the heating rotating body.

* * * * *